US012349719B2

(12) United States Patent
Clark et al.

(10) Patent No.: US 12,349,719 B2
(45) Date of Patent: Jul. 8, 2025

(54) BEADED SUBSTRATES FOR AEROSOL DELIVERY DEVICES

(71) Applicant: NICOVENTURES TRADING LIMITED, London (GB)

(72) Inventors: Caroline W. Clark, High Point, NC (US); Kyle Ford, Germanton, NC (US); Tiffany Comer, Pilot Mountain, NC (US); Luis Monsalud, Kernersville, NC (US)

(73) Assignee: NICOVENTURES TRADING LIMITED, London (GB)

( * ) Notice: Subject to any disclaimer, the term of this patent is extended or adjusted under 35 U.S.C. 154(b) by 350 days.

(21) Appl. No.: 17/698,331

(22) Filed: Mar. 18, 2022

(65) Prior Publication Data

US 2022/0295862 A1 Sep. 22, 2022

Related U.S. Application Data

(60) Provisional application No. 63/163,318, filed on Mar. 19, 2021.

(51) Int. Cl.
*A24B 15/14* (2006.01)
*A24B 3/14* (2006.01)
(Continued)

(52) U.S. Cl.
CPC ..... *A24B 15/14* (2013.01); *A24B 3/14* (2013.01); *A24B 13/00* (2013.01); *A24B 15/16* (2013.01);
(Continued)

(58) Field of Classification Search
USPC ..... 131/271, 328, 329
See application file for complete search history.

(56) References Cited

U.S. PATENT DOCUMENTS 2,033,909 A 3/1936 Cox et al.
3,860,012 A 1/1975 Selke
(Continued)

FOREIGN PATENT DOCUMENTS

CN 104856215 A 8/2015
CN 103750535 A 12/2015
(Continued)

OTHER PUBLICATIONS

"Modified Cross-Section Viscose Fibre: Galaxy VY—Trilobal Cellulosic Fibre," <htlps://web.archive.org/,veb/20160519070915/http://www.kelheim- fibres.com:80/pdf/TDS_Galaxy_VY_0814.pdf>, p. 1.

*Primary Examiner* — Manley L Cummins, IV
(74) *Attorney, Agent, or Firm* — Womble Bond Dickinson (US) LLP; Scott Breining

(57) ABSTRACT

A substrate in beaded form is provided which includes at least one non-tobacco botanical material, or a flavorant, a botanical extract, or both; a binder; an aerosol forming material; optionally, water and a tobacco material; and optionally a filler. The final form of the substrate can be configured for use in aerosol generating components for aerosol delivery devices. Further provided are aerosol generating components and aerosol delivery devices including the substrate in beaded form. Such devices utilize electrically generated heat or combustible ignition sources to heat the substrate, providing an inhalable substance in the form of an aerosol.

11 Claims, 5 Drawing Sheets

(51) Int. Cl.

| | |
|---|---|
| ***A24B 13/00*** | (2006.01) |
| ***A24B 15/16*** | (2020.01) |
| ***A24B 15/30*** | (2006.01) |
| ***A24D 1/20*** | (2020.01) |

(52) U.S. Cl.

CPC ..... *A24B 15/165* (2013.01); *A24B 15/302* (2013.01); *A24D 1/20* (2020.01)

(56) References Cited

U.S. PATENT DOCUMENTS 3,894,544 A 7/1975 Egri
4,079,742 A 3/1978 Rainer et al.
4,148,325 A 4/1979 Solomon et al.
4,646,764 A 3/1987 Young et al.
4,674,519 A 3/1987 Keritsis et al.
4,660,577 A 4/1987 Sensabaugh, Jr. et al.
4,725,440 A 2/1988 Ridgway et al.
4,735,217 A 4/1988 Gerth et al.
4,793,365 A 12/1988 Sensabaugh et al.
4,807,809 A 2/1989 Pryor et al.
4,848,374 A 7/1989 Chard et al.
4,922,901 A 5/1990 Brooks et al.
4,924,887 A 5/1990 Raker et al.
4,947,874 A 8/1990 Brooks et al.
4,947,875 A 8/1990 Brooks et al.
5,025,814 A 6/1991 Raker et al.
5,042,509 A 8/1991 Banerjee et al.
5,060,671 A 10/1991 Counts et al.
5,093,894 A 3/1992 Deevi et al.
5,101,839 A 4/1992 Jakob et al.
5,105,831 A 4/1992 Banerjee et al.
5,154,192 A 10/1992 Sprinkel et al.
5,159,942 A 11/1992 Brinkley et al.
5,203,355 A 4/1993 Clearmann et al.
5,224,498 A 7/1993 Deevi et al.
5,228,460 A 7/1993 Sprinkel, Jr. et al.
5,249,586 A 10/1993 Morgan et al.
5,261,424 A 11/1993 Sprinkel, Jr.
5,322,075 A 6/1994 Deevi et al.
5,353,813 A 10/1994 Deevi et al.
5,369,723 A 11/1994 Counts et al.
5,372,148 A 12/1994 McCafferty et al.
5,387,416 A 2/1995 White et al.
5,396,911 A 3/1995 Casey, III et al.
5,468,936 A 11/1995 Deevi et al.
5,498,850 A 3/1996 Das
5,498,855 A 3/1996 Deevi et al.
5,501,237 A 3/1996 Young et al.
5,530,225 A 6/1996 Hajaligol
5,551,451 A * 9/1996 Riggs ..... A24D 1/22 131/194
5,573,692 A 11/1996 Das et al.
5,591,368 A 1/1997 Fleischhauer et al.
5,598,868 A 2/1997 Jakob et al.
5,659,656 A 8/1997 Das
5,665,262 A 9/1997 Hajaligol et al.
5,666,977 A 9/1997 Higgins et al.
5,724,998 A 3/1998 Gellatly et al.
5,819,751 A 10/1998 Barnes et al.
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,077,524 A 6/2000 Bolder et al.
6,164,287 A 12/2000 White
6,196,218 B1 3/2001 Voges
6,510,855 B1 1/2003 Korte et al.
6,772,756 B2 8/2004 Shayan
6,803,545 B2 10/2004 Blake et al.
6,810,883 B2 11/2004 Felter et al.
6,834,654 B2 12/2004 Williams
6,854,461 B2 2/2005 Nichols et al.
7,025,066 B2 4/2006 Lawson et al.
7,032,601 B2 4/2006 Atchley et al.
7,040,314 B2 5/2006 Nguyen et al.
7,290,549 B2 11/2007 Banerjee et al.
7,293,565 B2 11/2007 Griffen et al.
7,428,905 B2 9/2008 Mua
7,513,253 B2 4/2009 Kobayashi et al.
7,615,184 B2 11/2009 Lobovsky et al.
7,647,932 B2 1/2010 Cantrell et al.
7,726,320 B2 6/2010 Robinson et al.
7,798,153 B2 9/2010 Lawrence, Jr.
7,832,410 B2 11/2010 Hon
7,896,006 B2 3/2011 Hamano et al.
7,950,399 B2 5/2011 Winterson et al.
7,980,251 B2 7/2011 Winterson et al.
8,079,371 B2 12/2011 Robinson et al.
8,124,147 B2 2/2012 Cheng et al.
8,156,944 B2 4/2012 Han
8,186,360 B2 5/2012 Marshall et al.
8,205,622 B2 6/2012 Pan
8,336,557 B2 12/2012 Kumar et al.
8,375,957 B2 2/2013 Hon
8,402,976 B2 3/2013 Fernando et al.
8,430,106 B2 4/2013 Potter et al.
8,469,036 B2 6/2013 Williams et al.
8,469,037 B2 6/2013 Liu et al.
8,528,569 B1 9/2013 Newton
8,529,914 B2 9/2013 Fuisz et al.
8,613,285 B2 12/2013 Fuisz
8,627,828 B2 1/2014 Strickland et al.
8,689,804 B2 4/2014 Fernando et al.
8,747,562 B2 6/2014 Mishra et al.
8,794,231 B2 8/2014 Thorens et al.
8,846,075 B2 9/2014 Jonsson et al.
8,851,083 B2 10/2014 Oglesby et al.
8,863,755 B2 10/2014 Zhuang et al.
8,910,639 B2 12/2014 Chang et al.
8,915,254 B2 12/2014 Monsees et al.
8,925,555 B2 1/2015 Monsees et al.
8,978,661 B2 3/2015 Atchley et al.
8,992,974 B2 3/2015 McCarty
9,044,049 B2 6/2015 Winterson et al.
9,066,540 B2 6/2015 Atchley et al.
9,078,473 B2 7/2015 Worm et al.
9,149,072 B2 10/2015 Conner et al.
9,161,567 B2 10/2015 Shikata et al.
9,161,908 B2 10/2015 Nilsson
9,167,835 B2 10/2015 Sengupta et al.
9,185,931 B2 11/2015 Gao et al.
9,220,302 B2 12/2015 DePiano et al.
9,237,768 B2 1/2016 Carroll et al.
9,345,268 B2 5/2016 Stone et al.
9,358,296 B2 6/2016 McCarty
9,402,414 B2 8/2016 Griscik et al.
9,414,624 B2 8/2016 Carroll et al.
9,423,152 B2 8/2016 Ampolini et al.
9,462,827 B2 10/2016 Carroll et al.
9,468,233 B2 10/2016 Macko et al.
9,484,155 B2 11/2016 Peckerar et al.
9,521,864 B2 12/2016 Gao et al.
9,693,582 B2 7/2017 Carroll et al.
9,788,571 B2 10/2017 Conner et al.
9,848,634 B2 12/2017 Fuisz
9,854,830 B2 1/2018 Gao et al.
9,854,831 B2 1/2018 Gao et al.
9,861,773 B2 1/2018 Terry et al.
9,884,015 B2 2/2018 Gao et al.
9,925,145 B2 3/2018 Hübinette et al.
9,930,909 B2 4/2018 Gao et al.
9,974,334 B2 5/2018 Dooly et al.
9,986,756 B2 6/2018 Gao et al.
9,999,243 B2 6/2018 Gao et al.
10,039,309 B2 8/2018 Carroll et al.
10,104,912 B2 10/2018 Sur
10,105,320 B2 10/2018 Gao et al.
10,130,120 B2 11/2018 Mishra et al.
10,172,810 B2 1/2019 McCarty
10,244,786 B2 4/2019 Gao et al.
10,292,431 B2 5/2019 White
10,314,330 B2 6/2019 Conner et al.

(56) References Cited

U.S. PATENT DOCUMENTS

| | | | | |
|---|---|---|---|---|
| 10,315,889 | B2 | 6/2019 | Kreischer et al. | |
| 10,321,707 | B2 | 6/2019 | Klipfel et al. | |
| 10,327,473 | B2 | 6/2019 | Mironov | |
| 10,334,873 | B2 | 7/2019 | Mishra et al. | |
| 10,405,572 | B2 | 9/2019 | Batista | |
| 10,412,989 | B2 | 9/2019 | Klipfel et al. | |
| 10,420,365 | B2 | 9/2019 | Klipfel et al. | |
| 10,440,995 | B2 | 10/2019 | Sebastian et al. | |
| 10,609,949 | B2 | 4/2020 | Hodin et al. | |
| 10,647,459 | B2 | 5/2020 | Persson | |
| 10,750,773 | B2 | 8/2020 | Yang et al. | |
| 10,791,756 | B2 | 10/2020 | Zuchuat et al. | |
| 10,798,969 | B2 | 10/2020 | Hejazi et al. | |
| 2004/0129280 | A1 | 7/2004 | Woodson et al. | |
| 2004/0226568 | A1 | 11/2004 | Takeuchi et al. | |
| 2006/0196518 | A1 | 9/2006 | Hon | |
| 2007/0215167 | A1 | 9/2007 | Crooks et al. | |
| 2008/0017203 | A1 | 1/2008 | Fagg et al. | |
| 2009/0044818 | A1 | 2/2009 | Takeuchi et al. | |
| 2009/0188490 | A1 | 7/2009 | Han | |
| 2010/0024834 | A1 | 2/2010 | Oglesby et al. | |
| 2010/0307518 | A1 | 12/2010 | Wang | |
| 2011/0139164 | A1* | 6/2011 | Mua | A24B 3/14 131/111 |
| 2013/0152956 | A1* | 6/2013 | von Borstel | A24B 15/16 131/329 |
| 2013/0251779 | A1 | 9/2013 | Svandal et al. | |
| 2014/0096781 | A1 | 4/2014 | Sears et al. | |
| 2014/0305448 | A1 | 10/2014 | Zuber et al. | |
| 2015/0096573 | A1 | 4/2015 | Gao et al. | |
| 2015/0096574 | A1 | 4/2015 | Gao et al. | |
| 2015/0096576 | A1 | 4/2015 | Gao et al. | |
| 2015/0150302 | A1 | 6/2015 | Metrangolo et al. | |
| 2015/0157052 | A1 | 6/2015 | Ademe et al. | |
| 2015/0313283 | A1 | 11/2015 | Collett et al. | |
| 2017/0055576 | A1 | 3/2017 | Beeson et al. | |
| 2017/0065000 | A1 | 3/2017 | Sears et al. | |
| 2017/0071250 | A1 | 3/2017 | Mironov et al. | |
| 2017/0099877 | A1 | 4/2017 | Worm et al. | |
| 2017/0112191 | A1 | 4/2017 | Sur et al. | |
| 2017/0280764 | A1 | 10/2017 | Sahlén et al. | |
| 2017/0318858 | A1 | 11/2017 | Hodin et al. | |
| 2018/0140007 | A1 | 5/2018 | Aspgren et al. | |
| 2018/0153211 | A1 | 6/2018 | Persson | |
| 2018/0237273 | A1 | 8/2018 | Kreischer et al. | |
| 2018/0255826 | A1 | 9/2018 | Persson et al. | |
| 2018/0279673 | A1 | 10/2018 | Sebastian et al. | |
| 2019/0082735 | A1* | 3/2019 | Phillips | A24F 40/46 |
| 2019/0124979 | A1 | 5/2019 | Sebastian et al. | |
| 2019/0255035 | A1 | 8/2019 | Bruun | |
| 2019/0281891 | A1 | 9/2019 | Hejazi et al. | |
| 2019/0291900 | A1 | 9/2019 | Persson et al. | |
| 2020/0093182 | A1 | 3/2020 | Monsalud et al. | |
| 2020/0154784 | A1 | 5/2020 | Sebastian et al. | |
| 2020/0281249 | A1 | 9/2020 | Sebastian et al. | |
| 2021/0195938 | A1* | 7/2021 | Mua | A24D 1/22 |
| 2022/0104532 | A1* | 4/2022 | Mua | A24B 15/40 |
| 2022/0295863 | A1* | 9/2022 | Clark | A24B 15/14 |

FOREIGN PATENT DOCUMENTS

| | | | |
|---|---|---|---|
| CN | 105747266 | A | 7/2016 |
| CN | 105919152 | A | 9/2016 |
| CN | 106235376 | A | 12/2016 |
| CN | 107616540 | A | 1/2018 |
| CN | 107616541 | A | 1/2018 |
| CN | 105768191 | A | 3/2018 |
| CN | 107927891 | A | 4/2018 |
| CN | 108143004 | A | 6/2018 |
| CN | 108208917 | A | 6/2018 |
| CN | 108323793 | A | 7/2018 |
| CN | 108451001 | A | 8/2018 |
| CN | 108451054 | A | 8/2018 |
| CN | 108497544 | A | 9/2018 |
| CN | 107259632 | A | 10/2018 |
| CN | 107307466 | A | 10/2018 |
| CN | 107319627 | A | 10/2018 |
| CN | 108652067 | A | 10/2018 |
| CN | 106368069 | A | 2/2019 |
| CN | 112438424 | | 3/2021 |
| GB | 2534213 | A | 2/2018 |
| WO | WO 1997/032490 | | 9/1997 |
| WO | WO 1997/032492 | | 9/1997 |
| WO | WO 1999/063844 | | 12/1999 |
| WO | WO 2010/003480 | | 1/2010 |
| WO | WO 2010/091593 | | 8/2010 |
| WO | WO 2010/113702 | | 10/2010 |
| WO | WO 2011/101164 | | 8/2011 |
| WO | WO 2012/133289 | | 10/2012 |
| WO | WO 2013/089551 | | 6/2013 |
| WO | WO 2013/178769 | | 12/2013 |
| WO | WO 2015/055567 | | 4/2015 |
| WO | WO 2015/082652 | | 6/2015 |
| WO | WO 2015/176898 | | 11/2015 |
| WO | WO 2015/177265 | | 11/2015 |
| WO | WO 2016/050471 | | 4/2016 |
| WO | WO 2016/156219 | | 10/2016 |
| WO | WO 2016/156598 | | 10/2016 |
| WO | WO 2016/162446 | | 10/2016 |
| WO | WO 2017/041920 | | 3/2017 |
| WO | WO 2017/051034 | | 3/2017 |
| WO | WO 2017/068091 | | 4/2017 |
| WO | WO 2017/068092 | | 4/2017 |
| WO | WO 2017/068093 | | 4/2017 |
| WO | WO 2017/068099 | | 4/2017 |
| WO | WO 2017/077110 | | 5/2017 |
| WO | WO 2017/077112 | | 5/2017 |
| WO | WO 2017/108912 | | 6/2017 |
| WO | WO 2018/033477 | | 2/2018 |
| WO | WO 2018/162515 | | 3/2018 |
| WO | WO 2018/172389 | | 3/2018 |
| WO | WO 2018/122070 | | 7/2018 |
| WO | WO 2018/152334 | | 8/2018 |
| WO | WO 2018/197454 | | 11/2018 |
| WO | WO 2018/215481 | | 11/2018 |
| WO | WO 2019/018248 | | 1/2019 |
| WO | WO 2019/036243 | | 2/2019 |
| WO | WO 2019/105960 | | 6/2019 |
| WO | WO 2019/115778 | | 6/2019 |
| WO | WO 2019/119732 | | 6/2019 |
| WO | WO 2019/162918 | | 8/2019 |
| WO | WO 2020/099170 | | 5/2020 |

* cited by examiner

BEADED SUBSTRATES FOR AEROSOL DELIVERY DEVICES

CROSS-REFERENCE TO RELATED APPLICATIONS

This application claims priority to U.S. Provisional Application No. 63/163,318, filed on Mar. 19, 2021, and which is incorporated herein by reference in its entirety and for all purposes.

FIELD OF THE DISCLOSURE

The present disclosure relates to aerosol generating components, aerosol delivery devices, and aerosol delivery systems, such as smoking articles that utilize electrically-generated heat or combustible ignition sources to heat aerosol forming materials, generally without significant combustion, in order to provide an inhalable substance in the form of an aerosol for human consumption.

BACKGROUND

Many smoking articles have been proposed through the years as improvements upon, or alternatives to, smoking products based upon combusting tobacco for use. Some example alternatives have included devices wherein a solid or liquid fuel is combusted to transfer heat to tobacco or wherein a chemical reaction is used to provide such heat source. Additional example alternatives use electrical energy to heat tobacco and/or other aerosol generating substrate materials, such as described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., each of which are incorporated herein by reference in their entireties.

Articles that produce the taste and sensation of smoking by electrically heating tobacco, tobacco-derived materials, or other plant derived materials have suffered from inconsistent performance characteristics. For example, some articles have suffered from inconsistent release of flavors or other inhalable materials, inadequate loading of aerosol forming materials on substrates, or the presence of poor sensory characteristics. Accordingly, it can be desirable to provide a smoking article that can provide the sensations of cigarette, cigar, or pipe smoking, that does so without combusting the substrate material and that does so with advantageous performance characteristics.

BRIEF SUMMARY

The present disclosure relates to substrates for use in aerosol delivery devices that utilize electrically-generated heat or combustible ignition sources to heat the substrate in order to provide an inhalable substance in the form of an aerosol for human consumption. Accordingly, in one aspect, the disclosure provides a substrate in beaded form for use in an aerosol delivery device, the substrate comprising: a tobacco material in particulate form; at least one non-tobacco botanical material (e.g., in extract or particulate form); a binder; water; and an aerosol forming component. In some embodiments, the substrates of the present disclosure are substantially free of tobacco material.

In some embodiments, the at least one non-tobacco botanical material is in particulate form. In some embodiments, the non-tobacco botanical material comprises eucalyptus, rooibos, star anise, fennel, or combinations thereof.

In some embodiments, the tobacco material is present in the substrate in an amount from about 10 to about 45% by weight, based on the total wet weight of the substrate.

In some embodiments, the tobacco material is substantially free of nicotine.

In some embodiments, the substrate is substantially free of nicotine.

In some embodiments, the binder is present in an amount from about 0.5 to about 1.5% by weight, based on the total wet weight of the substrate. In some embodiments, the binder is selected from the group consisting of alginates, seaweed hydrocolloids, cellulose ethers, starches, dextrans, carrageenan, povidone, pullulan, zein, and combinations thereof. In some embodiments, the binder is a cellulose ether selected from the group consisting of methylcellulose, hydroxypropylcellulose, hydroxypropylmethylcellulose, hydroxyethyl cellulose, carboxymethylcellulose, and combinations thereof. In some embodiments, the binder is carboxymethylcellulose.

In some embodiments, the aerosol forming component is selected from the group consisting of water, a polyhydric alcohol, a polysorbate, a sorbitan ester, a fatty acid, a fatty acid ester, a wax, a cannabinoid, a terpene, a sugar alcohol, or a combination thereof. In some embodiments, the aerosol forming component comprises a polyhydric alcohol. In some embodiments, the polyhydric alcohol is selected from the group consisting of glycerol, propylene glycol, 1,3-propanediol, diethylene glycol, triethylene glycol, triacetin, and combinations thereof.

In some embodiments, the polyhydric alcohol is present in an amount from about 10 to about 20% by weight, based on the total weight of the substrate.

In some embodiments, the water is present in an amount from about 20 to about 30% by weight, based on the total wet weight of the substrate.

In another aspect is provided a substrate in beaded form for use in an aerosol delivery device, the substrate comprising: a tobacco material; a flavorant, a botanical extract, or both; a binder; water; and an aerosol forming component.

In some embodiments, the botanical extract is present in an amount from about 1 to about 5% by weight, based on the total wet weight of the substrate. In some embodiments, the botanical extract is selected from the group consisting of an extract of Angelica root, caraway seed, cinnamon, clove, coriander seeds, elderberry, elderflower, ginger, jasmine, lavender, lilac, peppermint (*Mentha piperita*), quince, and combinations thereof.

In some embodiments, the flavorant comprises vanilla, mint, cherry, blueberry, or combinations thereof. In some embodiments, the flavorant comprises extracts of vanilla, mint, cherry, blueberry, or combinations thereof.

In some embodiments, the tobacco material is present in the substrate in an amount from about 55 to about 65% by weight, based on the total wet weight of the substrate.

In some embodiments, the binder is present in an amount from about 0.5 to about 1.5% by weight, based on the total wet weight of the substrate. In some embodiments, the binder is selected from the group consisting of alginates, seaweed hydrocolloids, cellulose ethers, starches, dextrans, carrageenan, povidone, pullulan, zein, and combinations thereof. In some embodiments, the binder is a cellulose ether selected from the group consisting of methylcellulose, hydroxypropylcellulose, hydroxypropylmethylcellulose, hydroxyethyl cellulose, carboxymethylcellulose, and combinations thereof. In some embodiments, the binder is carboxymethylcellulose.

In some embodiments, the aerosol forming component is selected from the group consisting of water, a polyhydric alcohol, a polysorbate, a sorbitan ester, a fatty acid, a fatty acid ester, a wax, a cannabinoid, a terpene, a sugar alcohol, or a combination thereof. In some embodiments, the aerosol forming component comprises a polyhydric alcohol. In some embodiments, the polyhydric alcohol is selected from the group consisting of glycerol, propylene glycol, 1,3-propanediol, diethylene glycol, triethylene glycol, triacetin, and combinations thereof.

In some embodiments, the water is present in an amount from about 10 to about 20% by weight, based on the total wet weight of the substrate.

In yet another aspect is provided a substrate in beaded form for use in an aerosol delivery device, the substrate comprising: a tobacco material in particulate form, wherein the tobacco material is substantially free of nicotine; a flavorant, a botanical extract, or both; a binder; a filler; water; and an aerosol forming component.

In some embodiments, the substrate is substantially free of nicotine.

In some embodiments, the botanical extract is present in an amount from about 1 to about 5% by weight, based on the total wet weight of the substrate. In some embodiments, the botanical extract is selected from the group consisting of an extract of Angelica root, caraway seed, cinnamon, clove, coriander seeds, elderberry, elderflower, ginger, jasmine, lavender, lilac, peppermint (Menthapiperita), quince, and combinations thereof.

In some embodiments, the flavorant comprises vanilla, mint, cherry, blueberry, or combinations thereof. In some embodiments, the flavorant comprises extracts of vanilla, mint, cherry, blueberry, or combinations thereof.

In some embodiments, the substrate comprises a botanical extract in an amount from about 1 to about 5% by weight, based on the total wet weight of the substrate, and a flavorant in an amount from about 1 to about 5% by weight, based on the total wet weight of the substrate, In some embodiments, the tobacco material is present in the substrate in an amount from about 10 to about 45% by weight, based on the total wet weight of the substrate.

In some embodiments, the binder is present in an amount from about 0.5 to about 1.5% by weight, based on the total wet weight of the substrate.

In some embodiments, the binder is selected from the group consisting of alginates, seaweed hydrocolloids, cellulose ethers, starches, gums, dextrans, carrageenan, povidone, pullulan, zein, or combinations thereof. In some embodiments, the binder is a cellulose ether selected from the group consisting of methylcellulose, hydroxypropylcellulose, hydroxypropylmethylcellulose, hydroxyethyl cellulose, carboxymethylcellulose, and combinations thereof. In some embodiments, the binder is carboxymethylcellulose.

In some embodiments, the filler is rice flour, present in an amount by weight from about 15 to about 25%, based on the total wet weight of the substrate.

In some embodiments, the aerosol forming component comprises water, a polyhydric alcohol, a polysorbate, a sorbitan ester, a fatty acid, a fatty acid ester, a wax, a cannabinoid, a terpene, a sugar alcohol, or a combination of any thereof. In some embodiments, the aerosol forming component comprises a polyhydric alcohol. In some embodiments, the polyhydric alcohol is selected from the group consisting of glycerol, propylene glycol, 1,3-propanediol, diethylene glycol, triethylene glycol, triacetin, and combinations thereof.

In some embodiments, the water is present in an amount from about 10 to about 20% by weight, based on the total wet weight of the substrate.

In another aspect is provided a substrate in beaded form for use in an aerosol delivery device, the substrate comprising: at least one non-tobacco botanical material; a binder; water; and an aerosol forming component.

In some embodiments, the substrate further comprises a tobacco material in particulate form.

In some embodiments, the at least one non-tobacco botanical material is in particulate form. In some embodiments, the non-tobacco botanical material comprises *eucalyptus*, rooibos, star anise, fennel, or combinations thereof.

In some embodiments, the substrate is substantially free of nicotine.

In some embodiments, the binder is present in an amount from about 0.5 to about 1.5% by weight, based on the total wet weight of the substrate. In some embodiments, the binder is selected from the group consisting of alginates, seaweed hydrocolloids, cellulose ethers, starches, dextrans, carrageenan, povidone, pullulan, zein, and combinations thereof. In some embodiments, the binder is a cellulose ether selected from the group consisting of methylcellulose, hydroxypropylcellulose, hydroxypropylmethylcellulose, hydroxyethyl cellulose, carboxymethylcellulose, and combinations thereof. In some embodiments, the binder is carboxymethylcellulose.

In some embodiments, the substrate further comprises a filler. In some embodiments, the filler is present in an amount by weight of up to about 45%, based on the total wet weight of the substrate. In some embodiments, the filler comprises wood pulp or wood fibers, inert fibers, or combinations thereof.

In some embodiments, the aerosol forming component is selected from the group consisting of water, a polyhydric alcohol, a polysorbate, a sorbitan ester, a fatty acid, a fatty acid ester, a wax, a cannabinoid, a terpene, a sugar alcohol, or a combination thereof. In some embodiments, the aerosol forming component comprises a polyhydric alcohol. In some embodiments, the polyhydric alcohol is selected from the group consisting of glycerol, propylene glycol, 1,3-propanediol, diethylene glycol, triethylene glycol, triacetin, and combinations thereof. In some embodiments, the polyhydric alcohol is present in an amount from about 10 to about 20% by weight, based on the total weight of the substrate. In some embodiments, the water is present in an amount from about 20 to about 30% by weight, based on the total wet weight of the substrate.

In a still further aspect is provided an aerosol delivery device comprising: the substrate as disclosed herein; a heat source configured to heat the substrate to form an aerosol;

and an aerosol pathway extending from the substrate to a mouth-end of the aerosol delivery device.

In some embodiments, the heat source comprises either an electrically powered heating element or a combustible ignition source. In some embodiments, the heat source is a combustible ignition source comprising a carbon-based material.

In some embodiments, the heat source is an electrically-powered heating element. In some embodiments, the aerosol delivery device further comprises a power source electronically connected to the heating element. In some embodiments, the aerosol delivery device further comprises a controller configured to control the power transmitted by the power source to the heating element.

The disclosure includes, without limitations, the following embodiments.

Embodiment 1: A substrate in beaded form for use in an aerosol delivery device, the substrate comprising: a tobacco material in particulate form; at least one non-tobacco botanical material; a binder; water; and an aerosol forming component.

Embodiment 2: The substrate of embodiment 1, wherein the at least one non-tobacco botanical material is in particulate form.

Embodiment 3: The substrate of embodiment 1 or 2, wherein the non-tobacco botanical material comprises eucalyptus, rooibos, star anise, fennel, or combinations thereof.

Embodiment 4: The substrate of any one of embodiments 1-3, wherein the tobacco material is present in the substrate in an amount from about 10 to about 45% by weight, based on the total wet weight of the substrate.

Embodiment 5: The substrate of any one of embodiments 1-4, wherein the tobacco material is substantially free of nicotine.

Embodiment 6: The substrate of any one of embodiments 1-5, wherein the substrate is substantially free of nicotine.

Embodiment 7: The substrate of any one of embodiments 1-6, wherein the binder is present in an amount from about 0.5 to about 1.5% by weight, based on the total wet weight of the substrate.

Embodiment 8: The substrate of any one of embodiments 1-7, wherein the binder is selected from the group consisting of alginates, seaweed hydrocolloids, cellulose ethers, starches, dextrans, carrageenan, povidone, pullulan, zein, and combinations thereof.

Embodiment 9: The substrate of any one of embodiments 1-8, wherein the binder is a cellulose ether selected from the group consisting of methylcellulose, hydroxypropylcellulose, hydroxypropylmethylcellulose, hydroxyethyl cellulose, carboxymethylcellulose, and combinations thereof.

Embodiment 10: The substrate of any one of embodiments 1-9, wherein the binder is carboxymethylcellulose.

Embodiment 11: The substrate of any one of embodiments 1-10, wherein the aerosol forming component is selected from the group consisting of water, a polyhydric alcohol, a polysorbate, a sorbitan ester, a fatty acid, a fatty acid ester, a wax, a cannabinoid, a terpene, a sugar alcohol, or a combination thereof.

Embodiment 12: The substrate of any one of embodiments 1-11, wherein the aerosol forming component comprises a polyhydric alcohol.

Embodiment 13: The substrate of any one of embodiments 1-12, wherein the polyhydric alcohol is selected from the group consisting of glycerol, propylene glycol, 1,3-propanediol, diethylene glycol, triethylene glycol, triacetin, and combinations thereof.

Embodiment 14: The substrate of any one of embodiments 1-13, wherein the polyhydric alcohol is present in an amount from about 10 to about 20% by weight, based on the total weight of the substrate.

Embodiment 15: The substrate of any one of embodiments 1-14, wherein the water is present in an amount from about 20 to about 30% by weight, based on the total wet weight of the substrate.

Embodiment 16: A substrate in beaded form for use in an aerosol delivery device, the substrate comprising: a milled tobacco material; a flavorant, a botanical extract (or botanical in other forms such as particulate), or both; a binder; water; and an aerosol forming component.

Embodiment 17: The substrate of embodiment 16, wherein the botanical extract is present in an amount from about 1 to about 5% by weight, based on the total wet weight of the substrate.

Embodiment 18: The substrate of embodiment 16 or 17, wherein the botanical extract is selected from the group consisting of an extract of Angelica root, caraway seed, cinnamon, clove, coriander seeds, elderberry, elderflower, ginger, jasmine, lavender, lilac, peppermint (Menthapiperita), quince, and combinations thereof.

Embodiment 19: The substrate of any one of embodiments 16-18, wherein the flavorant comprises vanilla, mint, cherry, blueberry, or combinations thereof.

Embodiment 20: The substrate of any one of embodiments 16-19, wherein the milled tobacco material is present in the substrate in an amount from about 55 to about 65% by weight, based on the total wet weight of the substrate.

Embodiment 21: The substrate of any one of embodiments 16-20, wherein the binder is present in an amount from about 0.5 to about 1.5% by weight, based on the total wet weight of the substrate.

Embodiment 22: The substrate of any one of embodiments 16-21, wherein the binder is selected from the group consisting of alginates, seaweed hydrocolloids, cellulose ethers, starches, dextrans, carrageenan, povidone, pullulan, zein, and combinations thereof.

Embodiment 23: The substrate of any one of embodiments 16-22 wherein the binder is a cellulose ether selected from the group consisting of methylcellulose, hydroxypropylcellulose, hydroxypropylmethylcellulose, hydroxyethyl cellulose, carboxymethylcellulose, and combinations thereof.

Embodiment 24: The substrate of any one of embodiments 16-23, wherein the binder is carboxymethylcellulose.

Embodiment 25: The substrate of any one of embodiments 16-24, wherein the aerosol forming component is selected from the group consisting of water, a polyhydric alcohol, a polysorbate, a sorbitan ester, a fatty acid, a fatty acid ester, a wax, a cannabinoid, a terpene, a sugar alcohol, or a combination thereof.

Embodiment 26: The substrate of any one of embodiments 16-25, wherein the aerosol forming component comprises a polyhydric alcohol.

Embodiment 27: The substrate of any one of embodiments 16-25, wherein the polyhydric alcohol is selected from the group consisting of glycerol, propylene glycol, 1,3-propanediol, diethylene glycol, triethylene glycol, triacetin, and combinations thereof.

Embodiment 28: The substrate of any one of embodiments 16-26, wherein the water is present in an amount from about 10 to about 20% by weight, based on the total wet weight of the substrate.

Embodiment 29: A substrate in beaded form for use in an aerosol delivery device, the substrate comprising: a tobacco material in particulate form, wherein the tobacco material is substantially free of nicotine; a flavorant, a botanical extract, or both; a binder; a filler; water; and an aerosol forming component.

Embodiment 30: The substrate of embodiment 29, wherein the substrate is substantially free of nicotine.

Embodiment 31: The substrate of embodiment 29 or 30, wherein the botanical extract is present in an amount from about 1 to about 5% by weight, based on the total wet weight of the substrate.

Embodiment 32: The substrate of any one of embodiments 29-31, wherein the botanical extract is selected from the group consisting of an extract of Angelica root, caraway seed, cinnamon, clove, coriander seeds, elderberry, elderflower, ginger, jasmine, lavender, lilac, peppermint (Menthapiperita), quince, and combinations thereof.

Embodiment 33: The substrate of any one of embodiments 29-32, wherein the flavorant comprises vanilla, mint, cherry, blueberry, or a combination thereof.

Embodiment 34: The substrate of any one of embodiments 29-33, comprising a botanical extract in an amount from about 1 to about 5% by weight, based on the total wet weight of the substrate, and a flavorant in an amount from about 1 to about 5% by weight, based on the total wet weight of the substrate, Embodiment 35: The substrate of any one of embodiments 29-34, wherein the milled tobacco material is present in the substrate in an amount from about 10 to about 45% by weight, based on the total wet weight of the substrate.

Embodiment 36: The substrate of any one of embodiments 29-35, wherein the binder is present in an amount from about 0.5 to about 1.5% by weight, based on the total wet weight of the substrate.

Embodiment 37: The substrate of any one of embodiments 29-36, wherein the binder is selected from the group consisting of alginates, seaweed hydrocolloids, cellulose ethers, starches, gums, dextrans, carrageenan, povidone, pullulan, zein, or combinations thereof.

Embodiment 38: The substrate of any one of embodiments 29-37, wherein the binder is a cellulose ether selected from the group consisting of methylcellulose, hydroxypropylcellulose, hydroxypropylmethylcellulose, hydroxyethyl cellulose, carboxymethylcellulose, and combinations thereof.

Embodiment 39: The substrate of any one of embodiments 29-38, wherein the binder is carboxymethylcellulose.

Embodiment 40: The substrate of any one of embodiments 29-39, wherein the filler is rice flour, present in an amount by weight from about 15 to about 25%, based on the total wet weight of the substrate.

Embodiment 41: The substrate of any one of embodiments 29-40, wherein the aerosol forming component comprises water, a polyhydric alcohol, a polysorbate, a sorbitan ester, a fatty acid, a fatty acid ester, a wax, a cannabinoid, a terpene, a sugar alcohol, or a combination of any thereof.

Embodiment 42: The substrate of any one of embodiments 29-41, wherein the aerosol forming component comprises a polyhydric alcohol.

Embodiment 43: The substrate of any one of embodiments 29-42, wherein the polyhydric alcohol is selected from the group consisting of glycerol, propylene glycol, 1,3-propanediol, diethylene glycol, triethylene glycol, triacetin, and combinations thereof.

Embodiment 44: The substrate of any one of embodiments 29-43, wherein the water is present in an amount from about 10 to about 20% by weight, based on the total wet weight of the substrate.

Embodiment 45: A substrate in beaded form for use in an aerosol delivery device, the substrate comprising: at least one non-tobacco botanical material; a binder; water; and an aerosol forming component.

Embodiment 46: The substrate of embodiment 45, further comprising a tobacco material in particulate form.

Embodiment 47: The substrate of embodiment 45 or 46, wherein the at least one non-tobacco botanical material is in particulate form.

Embodiment 48: The substrate of any one of embodiments 45-47, wherein the non-tobacco botanical material comprises eucalyptus, rooibos, star anise, fennel, or combinations thereof.

Embodiment 49: The substrate of any one of embodiments 45-48, wherein the substrate is substantially free of nicotine.

Embodiment 50: The substrate of any one of embodiments 45-49, wherein the binder is present in an amount from about 0.5 to about 1.5% by weight, based on the total wet weight of the substrate.

Embodiment 51: The substrate of any one of embodiments 45-50, wherein the binder is selected from the group consisting of alginates, seaweed hydrocolloids, cellulose ethers, starches, dextrans, carrageenan, povidone, pullulan, zein, and combinations thereof.

Embodiment 52: The substrate of any one of embodiments 45-51, wherein the binder is a cellulose ether selected from the group consisting of methylcellulose, hydroxypropylcellulose, hydroxypropylmethylcellulose, hydroxyethyl cellulose, carboxymethylcellulose, and combinations thereof.

Embodiment 53: The substrate of any one of embodiments 45-52, wherein the binder is carboxymethylcellulose.

Embodiment 54: The substrate of any one of embodiments 45-53, further comprising a filler in an amount by weight of up to about 45%, based on the total wet weight of the substrate.

Embodiment 55: The substrate of embodiment 54, wherein the filler comprises wood pulp, wood fibers, inert fibers, or a combination thereof.

Embodiment 56: The substrate of any one of embodiments 45-55, wherein the aerosol forming component is selected from the group consisting of water, a polyhydric alcohol, a polysorbate, a sorbitan ester, a fatty acid, a fatty acid ester, a wax, a cannabinoid, a terpene, a sugar alcohol, or a combination thereof.

Embodiment 57: The substrate of any one of embodiments 45-56, wherein the aerosol forming component comprises a polyhydric alcohol.

Embodiment 58: The substrate of any one of embodiments 45-57, wherein the polyhydric alcohol is selected from the group consisting of glycerol, propylene glycol, 1,3-propanediol, diethylene glycol, triethylene glycol, triacetin, and combinations thereof.

Embodiment 59: The substrate of any one of embodiments 45-58, wherein the polyhydric alcohol is present in an amount from about 10 to about 20% by weight, based on the total weight of the substrate.

Embodiment 60: The substrate of any one of embodiments 45-59, wherein the water is present in an amount from about 20 to about 30% by weight, based on the total wet weight of the substrate.

Embodiment 61: An aerosol delivery device, comprising: the substrate of any previous embodiment (e.g., any of Embodiments 1 to 60); a heat source configured to heat the substrate to form an aerosol; and an aerosol pathway extending from the substrate to a mouth-end of the aerosol delivery device.

Embodiment 62: The aerosol delivery device of embodiment 61, wherein the heat source comprises either an electrically powered heating element or a combustible ignition source.

Embodiment 63: The aerosol delivery device of embodiment 61 or 62, wherein the heat source is a combustible ignition source comprising a carbon-based material.

Embodiment 64: The aerosol delivery device of embodiment 61 or 62, wherein the heat source is an electrically-powered heating element.

Embodiment 65: The aerosol delivery device of embodiment 64, further comprising a power source electronically connected to the heating element.

Embodiment 66: The aerosol delivery device of embodiment 65, further comprising a controller configured to control the power transmitted by the power source to the heating element.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Having thus described aspects of the disclosure in the foregoing general terms, reference will now be made to the accompanying drawings, which are not necessarily drawn to scale. The drawings are exemplary only, and should not be construed as limiting the disclosure.

Figure 1:
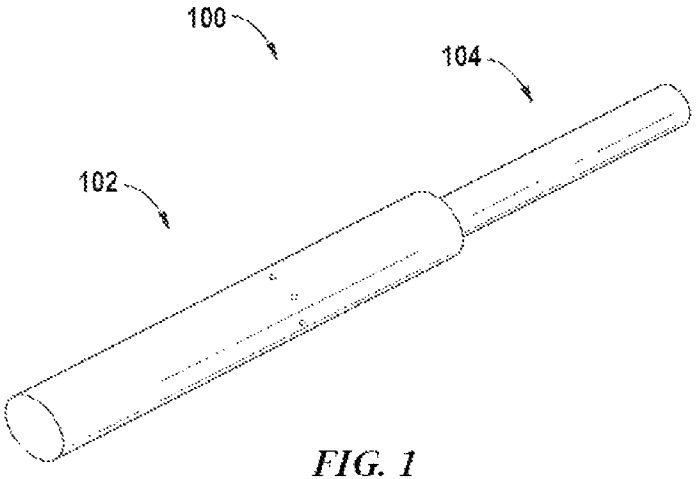
Figure 2:
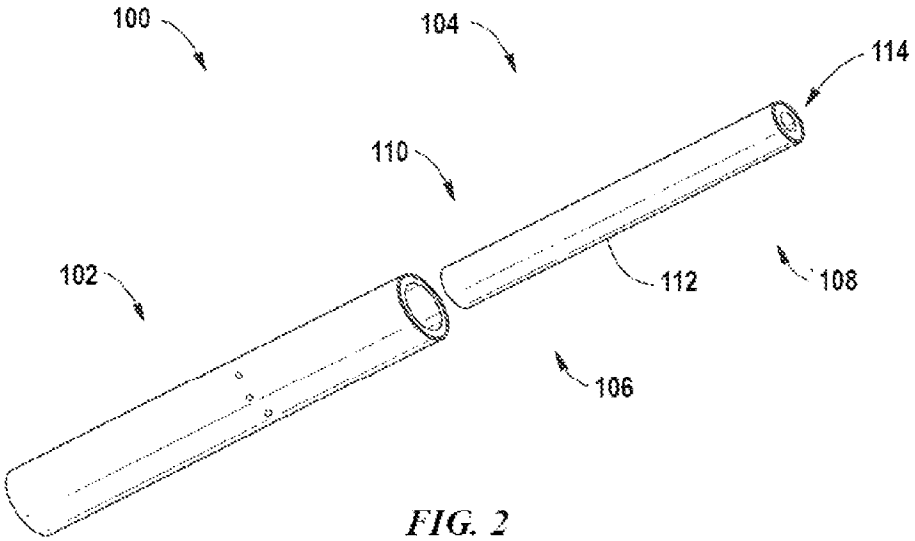
Figure 3:
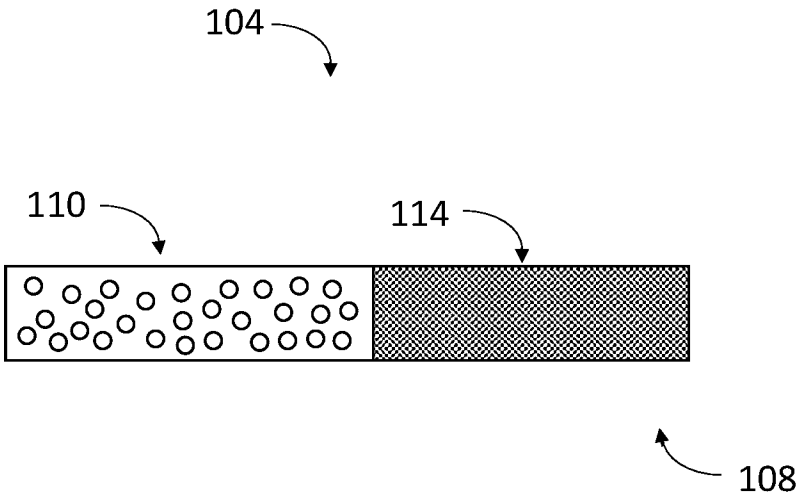
Figure 4:
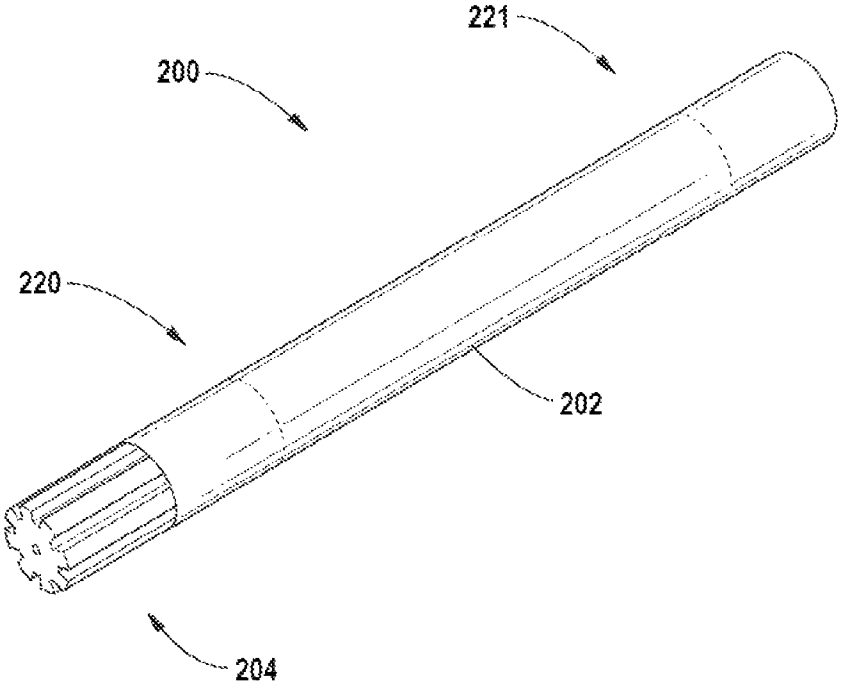
Figure 5:
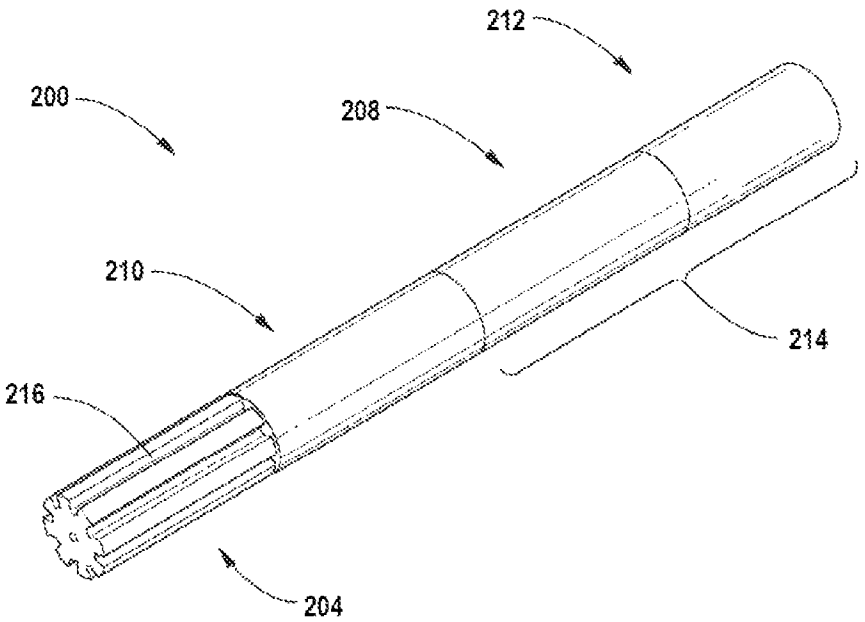

FIG. 1 illustrates a perspective view of an aerosol delivery device comprising a control body and an aerosol generating component, wherein the aerosol generating component and the control body are coupled to one another, according to an example embodiment of the present disclosure;

FIG. 2 illustrates a perspective view of the aerosol delivery device of FIG. 1, wherein the aerosol generating component and the control body are decoupled from one another, according to an example embodiment of the present disclosure;

FIG. 3 illustrates a perspective schematic view of an aerosol generating component, according to an example embodiment of the present disclosure;

FIG. 4 illustrates a perspective view of an aerosol generating component, according to an example embodiment of the present disclosure; and FIG. 5 illustrates a perspective view of the aerosol generating component of FIG. 4 with an outer wrap removed, according to one embodiment of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water). Reference to percent is intended to mean percent by weight unless otherwise indicated.

Substrate

As described hereinafter, example embodiments of the present disclosure relate to a substrate in beaded form for use in an aerosol delivery device. The substrate may comprise a variety of materials, alone or in combinations. The substrate of the disclosure generally comprises at least one non-tobacco botanical material; a botanical extract and/or flavorant; a binder; and an aerosol forming material, and may optionally contain a tobacco material and water. Each of the tobacco material, non-tobacco botanical material, botanical extract, flavorant, binder, water, and aerosol forming material are described further herein below.

Tobacco Material

In some embodiments, the substrate comprises a tobacco material. The tobacco material can vary in species, type, and form. Generally, the tobacco material is obtained from for a harvested plant of the *Nicotiana* species. Example *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N. x sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii*. Various representative other types of plants from the *Nicotiana* species are set forth in Goodspeed, *The Genus Nicotiana*, (Chonica Botanica) (1954); U.S. Pat. No. 4,660,577 to Sensabaugh, Jr. et al.; U.S. Pat. No. 5,387,416 to White et al., U.S. Pat. No. 7,025,066 to Lawson et al.; U.S. Pat. No. 7,798,153 to Lawrence, Jr. and U.S. Pat. No. 8,186,360 to Marshall et al.; each of which is incorporated herein by reference. Descriptions of various types of tobaccos, growing practices and harvesting practices are set forth in *Tobacco Production, Chemistry and Technology*, Davis et al. (Eds.) (1999), which is incorporated herein by reference.

*Nicotiana* species from which suitable tobacco materials can be obtained can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; US Patent Appl. Pub. No. 2006/0236434 to Conkling et al.; and PCT WO2008/103935 to Nielsen et al. See, also, the types of tobaccos that are set forth in U.S. Pat. No. 4,660,577 to Sensabaugh, Jr. et al.; U.S. Pat. No. 5,387,416 to White et al.; and U.S. Pat. No. 6,730,832 to Dominguez et al., each of which is incorporated herein by reference.

The *Nicotiana* species can, in some embodiments, be selected for the content of various compounds that are present therein. For example, plants can be selected on the basis that those plants produce relatively high quantities of one or more of the compounds desired to be isolated therefrom. In certain embodiments, plants of the *Nicotiana* species (e.g., *Galpao commun* tobacco) are specifically grown for their abundance of leaf surface compounds. Tobacco plants can be grown in greenhouses, growth chambers, or outdoors in fields, or grown hydroponically.

Various parts or portions of the plant of the *Nicotiana* species can be included within a substrate as disclosed herein. For example, virtually all of the plant (e.g., the whole plant) can be harvested, and employed as such. Alternatively, various parts or pieces of the plant can be harvested or separated for further use after harvest. For example, the flower, leaves, stem, stalk, roots, seeds, and various combinations thereof, can be isolated for further use or treatment. In some embodiments, the tobacco material comprises tobacco leaf (lamina). The substrate disclosed herein can include processed tobacco parts or pieces, cured and aged tobacco in essentially natural lamina and/or stem form. In certain embodiments, the tobacco material comprises solid tobacco material selected from the group consisting of lamina and stems. The tobacco that is used for the substrate most preferably includes tobacco lamina, or a tobacco lamina and stem mixture (of which at least a portion is smoke-treated). Portions of the tobacco may have processed forms, such as processed tobacco stems (e.g., cut-rolled stems, cut-rolled-expanded stems or cut-puffed stems), or volume expanded tobacco (e.g., puffed tobacco, such as dry ice expanded tobacco (DIET)). See, for example, the tobacco expansion processes set forth in U.S. Pat. No. 4,340,073 to de la Burde et al.; U.S. Pat. No. 5,259,403 to Guy et al.; and U.S. Pat. No. 5,908,032 to Poindexter, et al.; and U.S. Pat. No. 7,556,047 to Poindexter, et al., all of which are incorporated by reference. In addition, the substrate may incorporate tobacco that has been fermented. See, also, the types of tobacco processing techniques set forth in PCT WO2005/063060 to Atchley et al., which is incorporated herein by reference.

The tobacco material is typically used in a form that can be described as particulate, for example, shredded, ground, granulated, pulp, or powder form. In some embodiments, the tobacco material is employed in the form of parts or pieces that have an average particle size between 1.4 millimeters and 250 microns. In some instances, the tobacco particles may be sized to pass through a screen mesh to obtain the particle size range required. If desired, air classification equipment may be used to ensure that small sized tobacco particles of the desired sizes, or range of sizes, may be collected. If desired, differently sized pieces of granulated tobacco may be mixed together.

The manner by which the tobacco material is provided in a finely divided or powder type of form may vary. Preferably, plant parts or pieces are milled, comminuted, ground or pulverized into a particulate form using equipment and techniques for grinding, milling, or the like. The plant, or parts thereof, can be subjected to external forces or pressure (e.g., by being pressed or subjected to roll treatment). When carrying out such processing conditions, the plant or portion thereof can have a moisture content that approximates its natural moisture content (e.g., its moisture content immediately upon harvest), a moisture content achieved by adding moisture to the plant or portion thereof, or a moisture content that results from the drying of the plant or portion thereof. For example, powdered, pulverized, ground, pulped, or milled pieces of plants or portions thereof can have moisture contents of less than about 25 weight percent, often less than about 20 weight percent, and frequently less than about 15 weight percent. Most preferably, the plant material is relatively dry in form during grinding or milling, using equipment such as hammer mills, cutter heads, air control mills, or the like. For example, tobacco parts or pieces may be ground or milled when the moisture content thereof is less than about 15 weight percent or less than about 5 weight percent.

For the preparation of substrates, it is typical for a harvested plant of the *Nicotiana* species to be subjected to a curing process. The tobacco materials incorporated within the substrates as disclosed herein are generally those that have been appropriately cured and/or aged. Descriptions of various types of curing processes for various types of tobaccos are set forth in *Tobacco Production, Chemistry and Technology*, Davis et al. (Eds.) (1999). Examples of techniques and conditions for curing flue-cured tobacco are set forth in Nestor et al., Beitrage Tabakforsch. Int., 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., Beitrage Tabakforsch. Int., 21, 305-320 (2005) and Staaf et al., Beitrage Tabakforsch. Int., 21, 321-330 (2005), which are incorporated herein by reference. Certain types of tobaccos can be subjected to alternative types of curing processes, such as fire curing or sun curing.

In certain embodiments, tobacco materials that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Madole, Passanda, Cubano, Jatin and Bezuki tobaccos), light air cured (e.g., North Wisconsin and *Galpao* tobaccos), Indian air cured, Red Russian and *Rustica* tobaccos, as well as various other rare or specialty tobaccos and various blends of any of the foregoing tobaccos.

The tobacco material may also have a so-called "blended" form. For example, the tobacco material may include a mixture of parts or pieces of flue-cured, burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other example tobacco blends incorporate about 75 parts flue-cured tobacco, about 15 parts burley tobacco, and about 10 parts Oriental tobacco; or about 65 parts flue-cured tobacco, about 25 parts burley tobacco, and about 10 parts Oriental tobacco; or about 65 parts flue-cured tobacco, about 10 parts burley tobacco, and about 25 parts Oriental tobacco; on a dry weight basis. Other example tobacco blends incorporate about 20 to about 30 parts Oriental tobacco and about 70 to about 80 parts flue-cured tobacco on a dry weight basis.

Tobacco materials used in the present disclosure can be subjected to, for example, fermentation, bleaching, and the like. If desired, the tobacco materials can be, for example, irradiated, pasteurized, or otherwise subjected to controlled heat treatment. Such treatment processes are detailed, for example, in U.S. Pat. No. 8,061,362 to Mua et al., which is incorporated herein by reference. In certain embodiments, tobacco materials can be treated with water and an additive capable of inhibiting reaction of asparagine to form acrylamide upon heating of the tobacco material (e.g., an additive selected from the group consisting of lysine, glycine, histidine, alanine, methionine, cysteine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof. See, for example, the types of treatment processes described in U.S. Pat. Pub. Nos. 8,434,496, 8,944,072, and 8,991,403 to Chen et al., which are all incorporated herein by reference. In certain embodiments, this type of treatment is useful where the original tobacco material is subjected to heat in the processes previously described.

In some embodiments, the type of tobacco material is selected such that it is initially visually lighter in color than other tobacco materials to some degree (e.g., whitened or bleached). Tobacco pulp can be whitened in certain embodiments according to any means known in the art. For example, bleached tobacco material produced by various whitening methods using various bleaching or oxidizing agents and oxidation catalysts can be used. Example oxidizing agents include peroxides (e.g., hydrogen peroxide), chlorite salts, chlorate salts, perchlorate salts, hypochlorite salts, ozone, ammonia, potassium permanganate, and combinations thereof. Example oxidation catalysts are titanium dioxide, manganese dioxide, and combinations thereof. Processes for treating tobacco with bleaching agents are discussed, for example, in U.S. Pat. No. 787,611 to Daniels, Jr.; U.S. Pat. No. 1,086,306 to Oelenheinz; U.S. Pat. No. 1,437,095 to Delling; U.S. Pat. No. 1,757,477 to Rosenhoch; U.S. Pat. No. 2,122,421 to Hawkinson; U.S. Pat. No. 2,148,147 to Baier; U.S. Pat. No. 2,170,107 to Baier; U.S. Pat. No. 2,274,649 to Baier; U.S. Pat. No. 2,770,239 to Prats et al.; U.S. Pat. No. 3,612,065 to Rosen; U.S. Pat. No. 3,851,653 to Rosen; U.S. Pat. No. 3,889,689 to Rosen; U.S. Pat. No. 3,943,940 to Minami; U.S. Pat. No. 3,943,945 to Rosen; U.S. Pat. No. 4,143,666 to Rainer; U.S. Pat. No. 4,194,514 to Campbell; U.S. Pat. Nos. 4,366,823, 4,366,824, and 4,388,933 to Rainer et al.; U.S. Pat. No. 4,641,667 to Schmekel et al.; U.S. Pat. No. 5,713,376 to Berger; U.S. Pat. No. 9,339,058 to Byrd Jr. et al.; U.S. Pat. No. 9,420,825 to Beeson et al.; and U.S. Pat. No. 9,950,858 to Byrd Jr. et al.; as well as in US Pat. App. Pub. Nos. 2012/0067361 to Bjorkholm et al.; 2016/0073686 to Crooks; 2017/0020183 to Bjorkholm; and 2017/0112183 to Bjorkholm, and in PCT Publ. Appl. Nos. WO1996/031255 to Giolvas and WO2018/083114 to Bjorkholm, all of which are incorporated herein by reference.

In some embodiments, the whitened tobacco material can have an ISO brightness of at least about 50%, at least about 60%, at least about 65%, at least about 70%, at least about 75%, or at least about 80%. In some embodiments, the whitened tobacco material can have an ISO brightness in the range of about 50% to about 90%, about 55% to about 75%, or about 60% to about 70%. ISO brightness can be measured according to ISO 3688:1999 or ISO 2470-1:2016.

In some embodiments, the whitened tobacco material can be characterized as lightened in color (e.g., "whitened") in comparison to an untreated tobacco material. White colors are often defined with reference to the International Commission on Illumination's (CIE's) chromaticity diagram. The whitened tobacco material can, in certain embodiments, be characterized as closer on the chromaticity diagram to pure white than an untreated tobacco material.

The tobacco material may be processed to remove at least a portion of the nicotine present. Suitable methods of extracting nicotine from tobacco material are known in the art. In some embodiments, the tobacco material is substantially free of nicotine. By "substantially free" is meant that only trace amounts are present in the tobacco material. For example, in certain embodiments, the tobacco material can be characterized as having less than 0.001% by weight of nicotine, or less than 0.0001%, or even 0% by weight of nicotine, calculated as the free base, and based on the total weight of the tobacco material.

The quantity of tobacco material present may vary, and is generally less than about 65% by weight of the substrate, based on the total weight of the substrate. For example, a milled tobacco material may be present in a quantity from about 5%, from about 10%, from about 15%, from about 20%, about 25%, about 30%, or about 35%, to about 40%, about 45%, about 50%, about 55%, about 60%, or about 65% by weight of the substrate, based on the total wet weight of the substrate. In some embodiments, the tobacco material is present in the substrate in an amount from about 10 to about 45% by weight, based on the total wet weight of the substrate. In some embodiments, the tobacco material is present in the substrate in an amount from about 55 to about 65% by weight, based on the total wet weight of the substrate. In some embodiments, the tobacco material is present in the substrate in an amount from about 45 to about 55% by weight, based on the total dry weight of the substrate.

In some embodiments, the substrate of the disclosure can be characterized as completely free or substantially free of any tobacco material (e.g., any embodiment as disclosed herein may be completely or substantially free of any tobacco material). By "substantially free" is meant that no tobacco material has been intentionally added, beyond trace amounts that may be naturally present in e.g., botanical or herbal material. For example, certain embodiments can be characterized as having less than 0.5% by weight tobacco material, less than 0.1% by weight tobacco material, less than 0.01% by weight tobacco material, or less than 0.001%, or even 0% by weight tobacco material, based on the total wet weight of the substrate.

Tobacco-Derived Materials

In some embodiments, the substrate further comprises a tobacco extract, such as an aqueous tobacco extract, added either as a component of the aerosol forming material, or added separately (e.g., during substrate preparation, or impregnated in the substrate after formation). "Tobacco extract" as used herein refers to the isolated components of a tobacco material that are extracted from solid tobacco pulp by a solvent (e.g., water) that is brought into contact with the tobacco material in an extraction process. Various extraction techniques of tobacco materials can be used to provide a tobacco extract and tobacco solid material. See, for example, the extraction processes described in US Pat. Appl. Pub. No. 2011/0247640 to Beeson et al., which is incorporated herein by reference. Other example techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.;

U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

In some embodiments, the substrate comprises a tobacco extract, in aqueous or dry powder form, in an amount of from about 1 to about 5% by weight, based on the total wet weight of the substrate.

Non-Tobacco Botanicals

The substrates as disclosed herein comprise at least one non-tobacco botanical material. As used herein, the term "botanical ingredient" or "botanical" refers to any plant material or fungal-derived material, including plant material in its natural form and plant material derived from natural plant materials, such as extracts or isolates from plant materials or treated plant materials (e.g., plant materials subjected to heat treatment, fermentation, or other treatment processes capable of altering the chemical nature of the material). For the purposes of the present disclosure, a "botanical material" includes but is not limited to "herbal materials," which refer to seed-producing plants that do not develop persistent woody tissue and are often valued for their medicinal or sensory characteristics (e.g., teas or tisanes). Reference to botanical material as "non-tobacco" is intended to exclude tobacco materials (i.e., does not include any *Nicotiana* species). The botanical materials used in the present disclosure may comprise, without limitation, any of the compounds and sources set forth herein, including mixtures thereof. Certain botanical materials of this type are sometimes referred to as dietary supplements, nutraceuticals, "phytochemicals" or "functional foods."

Non-limiting examples of botanical materials include without limitation acai berry (*Euterpe oleracea martius*), acerola (*Malpighia glabra*), alfalfa, allspice, Angelica root, anise (e.g., star anise), annatto seed, apple (*Malus domestica*), apricot oil, bacopa monniera, basil (*Ocimum basilicum*), bee balm, beet root, bergamot, blackberry (*Morus nigra*), black cohosh, black pepper, black tea, blueberries, boldo (*Peumus boldus*), borage, bugleweed, cacao, calamus root, camu (*Myrcaria dubia*), cannabis/hemp, caraway seed, catnip, catuaba, cayenne, cayenne pepper, chaga mushroom, chamomile, cherry, chervil, chocolate, cinnamon (*Cinnamomum cassia*), citron grass (*Cymbopogon citratus*), clary sage, cloves, coconut (*Cocos nucifera*), coffee, comfrey leaf and root, coriander seed, cranberry, dandelion, Echinacea, elderberry, elderflower, endro (*Anethum graveolens*), evening primrose, eucalyptus, fennel, feverfew, garlic, ginger (*Zingiber officinale*), gingko biloba, ginseng, goji berries, goldenseal, grape seed, grapefruit, grapefruit rosé (*Citrus paradisi*), graviola (*Annona muricata*), green tea, gutu kola, hawthorn, hibiscus flower (*Hibiscus sabdariffa*), honeybush, jiaogulan, kava, jambu (*Spilanthes oleraceae*), jasmine (*Jasminum officinale*), juniper berry (*Juniperus communis*), lavender, lemon (*Citrus limon*), licorice, lilac, Lion's mane, maca (*Lepidium meyenii*), marjoram, milk thistle, mints (menthe), oolong tea, orange (*Citrus sinensis*), oregano, papaya, pennyroyal, peppermint (*Mentha piperita*), potato peel, quince, red clover, rooibos (red or green), rosehip (*Rosa canina*), rosemary, sage, Saint John's Wort, salvia (*Salvia officinalis*), savory, saw palmetto, silybum marianum, slippery elm bark, sorghum bran hi-tannin, sorghum grain hi-tannin, spearmint (*Mentha spicata*), spirulina, sumac bran, thyme, turmeric, uva ursi, valerian, vanilla, wild yam root, wintergreen, withania somnifera, yacon root, yellow dock, yerba mate, and yerba santa. In some embodiments, the non-tobacco botanical material is milled. In some embodiments, the milled non-tobacco botanical material comprises eucalyptus, rooibos, star anise, fennel, or combinations thereof.

In some embodiments, the non-tobacco botanical material is present in particulate form. The non-tobacco botanical material in particulate form may have a range of particle sizes. For example, in some embodiments, the non-tobacco botanical material has a particle size of from about 0.05 mm to about 1 mm. In some instances, the non-tobacco botanical material particles may be sized to pass through a screen mesh to obtain the particle size range required.

In some embodiments, the non-tobacco botanical material is present in the form of an extract. "Botanical extract" as used herein refers to the isolated components of a botanical material that are extracted from a solid botanical material by a solvent (e.g., water, alcohol, or the like) that is brought into contact with the solid botanical material in an extraction process. Various extraction techniques of solid botanical materials can be used to provide a botanical material extract. In some embodiments, the botanical extract is an extract of Angelica root, caraway seed, cinnamon, clove, coriander seeds, elderberry, elderflower, ginger, jasmine, lavender, lilac, peppermint (Menthapiperita), quince, or combinations thereof.

The quantity of non-tobacco botanical material present may vary, and is generally less than about 75% by weight of the substrate, based on the total wet weight of the substrate. For example, a non-tobacco botanical material may be present in a quantity from about 0.1%, about 0.5%, about 1%, about 5%, about 10%, about 15%, about 20%, about 25%, about 30%, about 35%, or about 40%, to about 45%, about 50%, about 55%, about 60%, about 65%, about 70%, or about 75% by weight of the substrate, based on the total wet weight of the substrate.

In some embodiments, the non-tobacco botanical material is in particulate form, and is present in the substrate in a quantity from about 15 to about 75% by weight, from about 15 to about 60% by weight, or from about 15 to about 25% by weight, based on the total wet weight of the substrate.

In some embodiments, the non-tobacco botanical material is present as an extract in an amount from about 1 to about 5%, or from about 1 to about 3% by weight, based on the total wet weight of the substrate.

Binder

The substrate as disclosed herein comprises a binder. A binder (or combination of binders) may be employed in certain embodiments, in amounts sufficient to provide the desired physical attributes and physical integrity to the substrate. The amount of binder utilized can vary, but is typically up to about 15 weight percent, and certain embodiments are characterized by a binder content of at least about 1% by weight, such as about 1 to about 30% by weight, or about 1 to about 20% by weight, or about 5 to about 15% by weight, based on the total wet weight of the substrate. In some embodiments, the binder is present in an amount by weight from about 5 to about 10%, or from about 6 to about 12%, based on the total wet weight of the substrate.

Typical binders can be organic or inorganic, or a combination thereof. Representative binders include povidone, sodium alginate, pectin, gums, carrageenan, pullulan, zein, cellulose derivatives, and the like, and combinations thereof. In some implementations, combinations or blends of two or more binder materials may be employed. Other examples of binder materials are described, for example, in U.S. Pat. No. 5,101,839 to Jakob et al.; and U.S. Pat. No. 4,924,887 to Raker et al., each of which is incorporated herein by reference in its entirety. In some embodiments, the binder does not comprise calcium carbonate.

In some embodiments, the binder is selected from the group consisting of alginates, seaweed hydrocolloids, cellulose ethers, starches, dextrans, carrageenan, povidone, pullulan, zein, or combinations thereof.

In some embodiments, the binder is a cellulose ether (including carboxyalkyl ethers), meaning a cellulose polymer with the hydrogen of one or more hydroxyl groups in the cellulose structure replaced with an alkyl, hydroxyalkyl, or aryl group. Non-limiting examples of such cellulose derivatives include methylcellulose, hydroxypropylcellulose ("HPC"), hydroxypropylmethylcellulose ("HPMC"), hydroxyethyl cellulose, and carboxymethylcellulose ("CMC"). Suitable cellulose ethers include hydroxypropylcellulose, such as Klucel H from Aqualon Co.; hydroxypropylmethylcellulose, such as Methocel K4MS from DuPont; hydroxyethylcellulose, such as Natrosol 250 MRCS from Aqualon Co.; methylcellulose, such as Methocel A4M, K4M, and E15 from DuPont.; and sodium carboxymethylcellulose, such as CMC 7F11, CMC 7LF, and CMC 7H4F from Aqualon Co. In some embodiments, the binder is one or more cellulose ethers (e.g., a single cellulose ether or a combination of several cellulose ethers, such as two or three, for example). In some embodiments, the binder is a cellulose ether selected from the group consisting of methylcellulose, hydroxypropylcellulose, hydroxypropylmethylcellulose, hydroxyethyl cellulose, carboxymethylcellulose, and combinations thereof. In some embodiments, the binder is carboxymethylcellulose. It is to be understood that in embodiments where the substrate comprises more than one cellulose ether, the stated weight basis of the binder reflects the total weight of the combination of cellulose ethers, based on the total wet weight of the substrate.

Water

In some embodiments, the substrate as disclosed herein comprises water. The water content may vary. For example, in some embodiments, the substrate comprises from about 15 to about 30% water. In some embodiments, the substrate beads are dried to remove at least a portion of the water present during preparation of the beads. In some embodiments, after drying, the substrate comprises from about 3 to about 9% water, based on the total weight of the substrate.

Aerosol Forming Material

Substrates as disclosed herein comprise an aerosol forming material. Suitable aerosol forming materials include, but are not limited to, water, polyhydric alcohols, polysorbates, sorbitan esters, fatty acids, fatty acid esters, waxes, terpenes, sugar alcohols, tobacco extract, and combinations thereof. In some embodiments, the aerosol forming material may include water, polyhydric alcohols, polysorbates, sorbitan esters, fatty acids, fatty acid esters, waxes, terpenes, sugar alcohols, tobacco extract, or a combination of any thereof. Each of polyhydric alcohols, polysorbates, sorbitan esters, fatty acids, fatty acid esters, waxes, terpenes, and sugar alcohols are further described herein below.

The amount of aerosol forming material that is present in the substrate is such that the substrate, or the aerosol generating component comprising the substrate, provides acceptable sensory and desirable performance characteristics. For example, in certain embodiments, sufficient amounts of aerosol forming material are employed in order to provide for the generation of a visible mainstream aerosol that in many regards resembles the appearance of tobacco smoke. The amount of aerosol forming materials present may be dependent upon factors such as the number of puffs desired per aerosol generating component.

In some embodiments, the substrate comprises the aerosol forming material in an amount of at least about 10% by weight, of at least about 15% by weight, at least about 20% by weight, at least about 25% by weight, at least about 30% by weight, at least about 35% by weight, at least about 40% by weight, at least about 45% by weight, at least about 50% by weight, at least about 55% by weight, or at least about 60% by weight, based on a total wet weight of the substrate. Example ranges of total aerosol forming materials include about 15% to about 60% by weight, such as about 15% to about 55%, or about 15% to about 25%, based on the total wet weight of the substrate.

Polyhydric Alcohols

In some embodiments, the aerosol forming material comprises one or more polyhydric alcohols. Examples of polyhydric alcohols include glycerol, propylene glycol, and other glycols such as 1,3-propanediol, diethylene glycol, and triethylene glycol. In some embodiments, the polyhydric alcohol is selected from the group consisting of glycerol, propylene glycol, 1,3-propanediol, diethylene glycol, triethylene glycol, triacetin, and combinations thereof.

In some embodiments, the polyhydric alcohol is a mixture of glycerol and propylene glycol. The glycerol and propylene glycol may be present in various ratios, with either component predominating depending on the intended application. In some embodiments, the glycerol and propylene glycol are present in a ratio by weight of from about 3:1 to about 1:3. In some embodiments, the glycerol and propylene glycol are present in a ratio by weight of about 3:1, about 2:1, about 1:1, about 1:2, or about 1:3. In some embodiments, the glycerol and propylene glycol are present in a ratio of about 1:1 by weight.

Polysorbates and Sorbitan Esters

In some embodiments, the aerosol forming material comprises one or more polysorbates. Examples of polysorbates include Polysorbate 60 (polyoxyethylene (20) sorbitan monostearate, Tween 60) and Polysorbate 80 (polyoxyethylene (20) sorbitan monooleate, Tween 80). The type of polysorbate used or the combination of polysorbates used depends on the intended effect desired, as the different polysorbates offer different attributes due to molecular sizes. For example, the polysorbate molecules increase in size from polysorbate 20 to polysorbate 80. Using smaller size polysorbate molecules creates less vapor quantity, but permits deeper lung penetration. This may be desirable when the user is in public where he would not want to create a large plume of "smoke" (i.e. vapors). Conversely, if a dense vapor is desired, which can convey the aromatic constituents of tobacco, larger polysorbate molecules can be employed.

An additional benefit of using the polysorbate family of compounds is that the polysorbates lower the heat of vaporization of mixtures in which they are present.

In some embodiments, the aerosol forming material comprises one or more sorbitan esters. Examples of sorbitan esters include sorbitan monolaurate, sorbitan monostearate (Span 60), sorbitan monooleate (Span 20), and sorbitan tristearate (Span 65).

Fatty Acids, Esters, and Waxes

In some embodiments, the aerosol forming material comprises one or more fatty acids. Fatty acids may include short-chain, long-chain, saturated, unsaturated, straight chain, or branched chain carboxylic acids. Fatty acids generally include $C_4$ to $C_{28}$ aliphatic carboxylic acids. Non-limiting examples of short- or long-chain fatty acids include butyric, propionic, valeric, oleic, linoleic, stearic, myristic, and palmitic acids.

In some embodiments, the aerosol forming material comprises one or more fatty acid esters. Examples of fatty acid esters include alkyl esters, monoglycerides, diglycerides, and triglycerides. Examples of monoglycerides include monolaurin and glycerol monostearate.

Examples of triglycerides include triolein, tripalmitin, tristearate, glycerol tributyrate, and glycerol trihexanoate).

In some embodiments, the aerosol forming material comprises one or more waxes. Examples of waxes include carnauba, beeswax, candellila, which are known known to stabilize aerosol particles, improve palatability, or reduce throat irritation.

Terpenes

In some embodiments, the aerosol forming material comprises one or more terpenes. As used herein, the term "terpenes" refers to hydrocarbon compounds produced by plants biosynthetically from isopentenyl pyrophosphate. Non-limiting examples of terpenes include limonene, pinene, farnesene, myrcene, geraniol, fennel, and cembrene.

Sugar Alcohols

In some embodiments, the aerosol forming material comprises one or more sugar alcohols. Examples of sugar alcohols include sorbitol, erythritol, mannitol, maltitol, isomalt, and xylitol. Sugar alcohols may also serve as flavor enhancers to certain flavor compounds, e.g. menthol and other volatiles, and generally improve on mouthfeel, tactile sensation, throat impact, and other sensory properties, of the resulting aerosol.

Methods for loading (e.g., impregnating) aerosol forming material into or onto substrate portions are described in U.S. Pat. No. 9,974,334 to Dooly et al., and U.S. Pub. Pat. App. Nos. 2015/0313283 to Collett et al. and 2018/0279673 to Sebastian et al., the disclosures of which are incorporated by reference herein in their entirety.

In any of the disclosed embodiments, the entire quantity of aerosol forming material may be added prior to extrusion. Alternatively, or in addition, a portion of the aerosol forming material may be added to the substrate post-formation (e.g., one or more aerosol forming materials may be sprayed or otherwise disposed in or on the substrate material in extruded form.

Fillers

In some embodiments, the substrates as disclosed herein comprise a filler. The filler may comprise materials such as starches, sugars, sugar alcohols, wood fibers, wood pulp, inorganic substances, inert materials, and the like. In some embodiments, the filler comprises a starch, including native and modified starches. "Starch" as used herein may refer to pure starch from any source, modified starch, or starch derivatives. Starch is present, typically in granular form, in almost all green plants and in various types of plant tissues and organs (e.g., seeds, leaves, rhizomes, roots, tubers, shoots, fruits, grains, and stems). Starch can vary in composition, as well as in granular shape and size. Often, starch from different sources has different chemical and physical characteristics. A specific starch can be selected for inclusion in the beads based on the ability of the starch material to impart a specific organoleptic property to the beads. Starches derived from various sources can be used. For example, major sources of starch include cereal grains (e.g., rice, wheat, and maize) and root vegetables (e.g., potatoes and cassava). Other examples of sources of starch include acorns, arrowroot, arracacha, bananas, barley, beans (e.g., favas, lentils, mung beans, peas, chickpeas), breadfruit, buckwheat, canna, chestnuts, colacasia, katakuri, kudzu, malanga, millet, oats, oca, Polynesian arrowroot, sago, sorghum, sweet potato, quinoa, rye, tapioca, taro, tobacco, water chestnuts, and yams. Suitable starches include, but are not limited to, corn starch, rice starch, and modified food starches. Certain starches are modified starches. A modified starch has undergone one or more structural modifications, often designed to alter its high heat properties. Some starches have been developed by genetic modifications, and are considered to be "modified" starches. Other starches are obtained and subsequently modified. For example, modified starches can be starches that have been subjected to chemical reactions, such as esterification, etherification, oxidation, depolymerization (thinning) by acid catalysis or oxidation in the presence of base, bleaching, transglycosylation and depolymerization (e.g., dextrinization in the presence of a catalyst), cross-linking, enzyme treatment, acetylation, hydroxypropylation, and/or partial hydrolysis. Other starches are modified by heat treatments, such as pregelatinization, dextrinization, and/or cold water swelling processes. Certain modified starches include monostarch phosphate, distarch glycerol, distarch phosphate esterified with sodium trimetaphosphate, phosphate distarch phosphate, acetylated distarch phosphate, starch acetate esterified with acetic anhydride, starch acetate esterified with vinyl acetate, acetylated distarch adipate, acetylated distarch glycerol, hydroxypropyl starch, hydroxypropyl distarch glycerol, and starch sodium octenyl succinate. In some embodiments, the filler comprises corn starch, rice starch or rice flour, modified food starch, or a combination thereof. In some embodiments, the filler does not comprise calcium carbonate. In some embodiments, the filler comprises wood fibers, wood pulp, inert fibers, or combinations thereof.

When present, the amount of filler can vary. In some embodiments, the substrate is free of filler. In some embodiments, the substrate comprises up to about 45% filler, based on the total wet weight of the substrate. In some embodiments, the substrate comprises from about 5, about 10, about 15, about 20 or about 25, to about 30, about 35, about 40, or about 45% filler by weight, based on the total wet weight of the substrate. In some embodiments, the filler is wood fibers or wood pulp. In some embodiments, the substrate comprises from about 15 to about 25% filler, based on the total wet weight of the substrate. In some embodiments, the filler is rice flour.

Nicotine Component

In certain embodiments, the substrate comprises a nicotine component. By "nicotine component" is meant any suitable form of nicotine (e.g., free base or salt) for providing an aerosol of at least a portion of the nicotine present. Typically, the nicotine component is selected from the group consisting of nicotine free base and a nicotine salt. In some embodiments, the nicotine component is nicotine in its free base form, which easily can be adsorbed in for example, a microcrystalline cellulose material to form a microcrystalline cellulose-nicotine carrier complex. See, for example, the discussion of nicotine in free base form in US Pat. Pub. No. 2004/0191322 to Hansson, which is incorporated herein by reference.

In some embodiments, at least a portion of the nicotine component can be employed in the form of a salt. Salts of nicotine can be provided using the types of ingredients and techniques set forth in U.S. Pat. No. 2,033,909 to Cox et al. and Perfetti, Beitrage Tabakforschung Int., 12: 43-54 (1983), which are incorporated herein by reference. Additionally, salts of nicotine are available from sources such as Pfaltz and Bauer, Inc. and K&K Laboratories, Division of ICN Biochemicals, Inc. Typically, the nicotine component is selected from the group consisting of nicotine free base, a nicotine salt such as hydrochloride, dihydrochloride, monotartrate, bitartrate, sulfate, salicylate, and nicotine zinc chloride.

Typically, the nicotine component (calculated as the free base) when present, is in a concentration of at least about 0.001% by weight of the substrate, such as in a range from about 0.001% to about 10%, based on the total wet weight of the substrate. In some embodiments, the nicotine component is present in a concentration from about 0.1% w/w to about 10% by weight, such as, e.g., from about from about 0.1%, about 0.2%, about 0.3%, about 0.4%, about 0.5% about 0.6%, about 0.7%, about 0.8%, or about 0.9%, to about 1%, about 2%, about 3%, about 4%, about 5%, about 6%, about 7%, about 8%, about 9%, or about 10% by weight, calculated as the free base and based on the total wet weight of the substrate. In some embodiments, the nicotine component is present in a concentration from about 0.1% to about 3% by weight, such as, e.g., from about from about 0.1% to about 2.5%, from about 0.1% to about 2.0%, from about 0.1% to about 1.5%, or from about 0.1% to about 1% by weight, calculated as the free base and based on the total wet weight of the substrate. In some embodiments, the nicotine present is all provided by the native content in the milled tobacco material. In other embodiments, the nicotine component is added exogenously to the substrate.

In some embodiments, the substrate of the disclosure can be characterized as completely free or substantially free of any nicotine component (e.g., any embodiment as disclosed herein may be completely or substantially free of any nicotine component). By "substantially free" is meant that no nicotine has been intentionally added, beyond trace amounts that may be naturally present in e.g., a tobacco, botanical or herbal material. For example, certain embodiments can be characterized as having less than 0.001% by weight of nicotine, or less than 0.0001%, or even 0% by weight of nicotine, calculated as the free base, and based on the total wet weight of the substrate.

Flavorant

In some embodiments, the substrate comprises a flavorant. As used herein, reference to a "flavorant" refers to compounds or components that can be aerosolized and delivered to a user and which impart a sensory experience in terms of taste and/or aroma. Some examples of flavorants include, but are not limited to, vanillin, ethyl vanillin, cream, tea, coffee, fruit (e.g., apple, blueberry, cherry, strawberry, peach and citrus flavors, including lime and lemon), maple, menthol, mint, peppermint, spearmint, wintergreen, nutmeg, clove, lavender, cardamom, ginger, honey, anise, sage, rosemary, hibiscus, rose hip, yerba mate, guayusa, honeybush, rooibos, yerba santa, bacopa monniera, gingko biloba, withania somnifera, cinnamon, sandalwood, jasmine, cascarilla, cocoa, licorice, combinations thereof, and extracts, flavorings and flavor packages of the type and character traditionally used for the flavoring of cigarette, cigar, and pipe tobaccos.

In some embodiments, the flavorant comprises berry, clove, or citrus flavors and/or aromas. In some embodiments, the flavorant comprises vanilla, mint, cherry, blueberry, or combinations thereof. In some embodiments, the flavorant comprises extracts of vanilla, mint, cherry, blueberry, or combinations thereof. In some embodiments, the flavorant comprises vanilla, mint, cherry, blueberry, or a combination thereof, and further comprises an extract of vanilla, mint, cherry, blueberry, or a combination thereof.

Syrups, such as high fructose corn syrup, also can be employed. Some examples of plant-derived compositions that may be suitable are disclosed in U.S. Pat. No. 9,107,453 and U.S. Pat. App. Pub. No. 2012/0152265 both to Dube et al., the disclosures of which are incorporated herein by reference in their entireties. The selection of such further components is variable based upon factors such as the sensory characteristics that are desired for the smoking article, their affinity for the substrate material, their solubility, and other physiochemical properties. The present disclosure is intended to encompass any such further components that are readily apparent to those skilled in the art of tobacco and tobacco-related or tobacco-derived products. See, e.g., Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. It should be noted that reference to a flavorant should not be limited to any single flavorant as described above, and may, in fact, represent a combination of one or more flavorants. Additional flavorants, flavoring agents, additives, and other possible enhancing constituents are described in U.S. Pat. App. Pub. No. 2019/0082735 to Phillips et al., which is incorporated herein by reference in its entirety.

The quantity of flavorant present may vary, and when present, is generally less than about 30%, or less than about 20% by weight of the substrate, based on the total weight of the substrate. For example, a flavorant may be present in a quantity of from about 0.1%, about 0.5%, about 1%, or about 5%, to about 10%, about 20%, or about 30% by weight of the substrate, based on the total wet weight of the substrate. In some embodiments, the flavorant is present in an amount from about 1 to about 5% by weight, based on the total wet weight of the substrate. In some embodiments, the flavorant is present in an amount from about 1 to about 3% by weight, based on the total wet weight of the substrate.

Other Components

In some embodiments, the substrate may further comprise a burn retardant material, conductive fibers or particles for heat conduction/induction, or any combination thereof. One example of a burn retardant material is ammonium phosphate. In some embodiments, other flame/burn retardant materials and additives may be included within the substrate, and may include organo-phosphorus compounds, borax, hydrated alumina, graphite, potassium, silica, tripolyphosphate, dipentaerythritol, pentaerythritol, and polyols. Other burn retardant materials, such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides may also be used. In each aspect of flame-retardant, burn-retardant, and/or scorch-retardant materials used in the substrate material and/or other components (whether alone or in combination with each other and/or other materials), the desirable properties are independent of and resistant to undesirable off-gassing or melting-type behavior. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

The substrate may also include conductive fibers or particles for heat conduction or heating by induction. In some embodiments, the conductive fibers or particles may be arranged in a substantially linear and parallel pattern. In some embodiments, the conductive fibers or particles may have a substantially random arrangement. In some embodiments, the conductive fibers or particles may be constructed of or more of an aluminum material, a stainless steel material, a copper material, a carbon material, and a graphite material. In some embodiments, one or more conductive fibers or particles with different Curie temperatures may be included in the substrate material to facilitate heating by induction at varying temperatures.

In still other implementations, the substrate material may comprise inorganic fibers of various types (e.g., fiber glass, metal wires/screens, etc.) and/or (organic) synthetic polymers. In various implementations, these "fibrous" materials could be unstructured (e.g., randomly distributed) or structured (e.g., a wire mesh).

Form of Substrate

The form of the substrate may vary. In some embodiments, the substrate is in beaded form. By "beaded form" is meant that the substrate material is in the form of granules or pellets that can have any of a variety of cross-sectional shapes, including rounded, spherical, ovoid, or irregular shapes. The beaded material is typically flowable such that the beaded material can be readily deposited into an outer housing for use in e.g., an aerosol delivery device such as disclosed herein below. In some embodiments, the beads are rounded or spherical. The size of the beads may vary. In some embodiments, the beads are between 8 and 16 mesh (average particle size distribution of 0.149 mm, and a bead weight of 25 to 26 milligrams). Although a beaded form of substrate is advantageous in the present disclosure, in certain embodiments, other forms could be utilized, such as a substrate sheet including gathered sheet form, shredded or particulate forms, and the like.

Preparation of Substrate

Generally, the substrate as disclosed herein is prepared using extrusion and spheronization technology. As a non-limiting example description, the beaded substrate disclosed herein may be prepared by combining the individual substrate components (e.g., milled tobacco, milled botanical or botanical extract, binder, water, optional filler, and at least a portion of the aerosol forming material), to form a slurry, extruding the slurry, and spheronizing the extrudate.

The manner by which the various components are combined may vary. For example, the components noted above, which may be in liquid or dry solid form, can be admixed in a pretreatment step prior to mixture with any remaining components, or simply mixed together with all other liquid or dry ingredients. Any individual component of the substrate may be added to any other substrate components, either individually or in any combination. In some embodiments, additional components may be added (e.g., fillers, flavorants, and the like) to form the slurry prior to extrusion.

The various components of the substrate may be contacted, combined, or mixed together using any mixing technique or equipment known in the art. Any mixing method that brings the substrate ingredients into intimate contact can be used, such as a mixing apparatus featuring an impeller or other structure capable of agitation. Examples of mixing equipment include casing drums, conditioning cylinders or drums, liquid spray apparatus, conical-type blenders, ribbon blenders, mixers available as FKM130, FKM600, FKM1200, FKM2000 and FKM3000 from Littleford Day, Inc., Plough Share types of mixer cylinders, Hobart mixers, and the like. See also, for example, the types of methodologies set forth in U.S. Pat. No. 4,148,325 to Solomon et al.; U.S. Pat. No. 6,510,855 to Korte et al.; and U.S. Pat. No. 6,834,654 to Williams, each of which is incorporated herein by reference. Manners and methods for formulating mixtures will be apparent to those skilled in the art. See, for example, the types of methodologies set forth in U.S. Pat. No. 4,148,325 to Solomon et al.; U.S. Pat. No. 6,510,855 to Korte et al.; and U.S. Pat. No. 6,834,654 to Williams, U.S. Pat. No. 4,725,440 to Ridgway et al., and U.S. Pat. No. 6,077,524 to Bolder et al., each of which is incorporated herein by reference.

The slurry is then extruded. The extrusion can be carried out using extruders such as screw, sieve, basket, roll, and ram-type extruders, extruding the slurry through suitably sized pierced screens. Any suitable extrudate shape may be used. In some embodiments, the agglomerate is extruded into rods. The extrudate is then processed in a spheronizer (e.g., such as spheronizers (marumerizers) available from Caleva Process Solutions Ltd. or LCI Corporation) at a suitable rotation speed (e.g., 1200 RPM) for a suitable time (e.g., 10 minutes). For example, spheronization can be carried out using a spinning friction plate that effects rounding of extrudate particles.

The beads may optionally be dried to remove at least a portion of the liquid content (e.g., water). The resulting beads may be dried in fluid bed dryers, apron dryers, rotary dryers, flash dryers, tray dryers or plow mixers. The final moisture content may be from 3-20% moisture by weight on a wet basis.

Following the optional drying, the variously-sized beads can be processed through a series of screens to provide the desired size range, such as the sizes noted above (e.g., from about 8 to about 16 mesh). Additionally, flavorants, extracts, aerosol forming materials, and the like can be added to the beads after drying.

Substrate Loading

In various embodiments, the substrate may be associated with the aerosol forming material by impregnating the substrate with the aerosol forming material during preparation of the substrate material, after formation of the substrate material, or both. For example, in some embodiments, a portion of the aerosol forming material (e.g., glycerol or propylene glycol) is added to the slurry used to form the substrate during e.g., making of a sheet, and a second portion of the aerosol forming material (e.g., glycerol or propylene glycol) is added to the sheet as a top dressing (for example, by spraying) to form the substrate carrying the aerosol forming material. In other embodiments, the entirety of the aerosol forming material is added to the slurry used to form the substrate during the making of the substrate. In some embodiments, further aerosol forming materials may be impregnated in or on the substrate, either by adding further aerosol forming materials to the substrate forming slurry, or as a top dressing to the substrate. As one of skill will recognize, multiple permutations of methods for loading the substrate with the aerosol forming material is possible, depending on the specific substrate material, form, and the like. Accordingly, any such modifications are contemplated herein.

Aerosol Generating Components and Aerosol Delivery Devices

Substrates (e.g., in extruded sheet form or beaded form) according to certain embodiments of the disclosure can be used in aerosol delivery devices or the aerosol generating components thereof. Accordingly, further example embodiments of the present disclosure relate to an aerosol delivery device comprising an aerosol generating component comprising the substrate as disclosed herein; a heat source configured to heat the aerosol forming materials carried in the substrate portion to form an aerosol; and an aerosol pathway extending from the aerosol generating component to a mouth-end of the aerosol delivery device. The individual components and construction of the aerosol generating component and aerosol delivery device are provided herein below.

Aerosol generating components of certain example aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example embodiments of the present disclosure can hold and use that component much like a smoker employs a traditional type of smoking article, draw on one end of that piece for inhalation of aerosol produced by that piece, take or draw puffs at selected intervals of time, and the like.

While the systems are generally described herein in terms of embodiments associated with aerosol delivery devices and/or aerosol generating components such as so-called "e-cigarettes" or "tobacco heating products," it should be understood that the mechanisms, components, features, and methods may be embodied in many different forms and associated with a variety of articles. For example, the description provided herein may be employed in conjunction with embodiments of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of embodiments relating to aerosol delivery devices by way of example only, and may be embodied and used in various other products and methods.

Aerosol delivery devices and/or aerosol generating components of the present disclosure may also be characterized as being vapor-producing articles or medicament delivery articles. Thus, such articles or devices may be adapted so as to provide one or more substances (e.g., flavors and/or pharmaceutical active ingredients) in an inhalable form or state. For example, inhalable substances may be substantially in the form of a vapor (i.e., a substance that is in the gas phase at a temperature lower than its critical point). Alternatively, inhalable substances may be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like. The physical form of the inhalable substance is not necessarily limited by the nature of the inventive devices but rather may depend upon the nature of the medium and the inhalable substance itself as to whether it exists in a vapor state or an aerosol state. In some embodiments, the terms "vapor" and "aerosol" may be interchangeable. Thus, for simplicity, the terms "vapor" and "aerosol" as used to describe aspects of the disclosure are understood to be interchangeable unless stated otherwise.

More specific formats, configurations and arrangements of various substrate materials, aerosol generating components, and components within aerosol delivery devices of the present disclosure will be evident in light of the further disclosure provided hereinafter. Additionally, the selection of various aerosol delivery device components may be appreciated upon consideration of the commercially available electronic aerosol delivery devices. Further, the arrangement of the components within the aerosol delivery device may also be appreciated upon consideration of the commercially available electronic aerosol delivery devices.

Substrates (e.g., in extruded sheet form or beaded form) according to certain embodiments of the disclosure can be used in aerosol generating segments of heat-not-burn (HNB) devices. which use an ignitable heat source to heat a material (generally without combusting the material to any significant degree) to form an inhalable substance (e.g., carbon heated tobacco products). The material is typically heated without combusting the material to any significant degree. See, for example, US Patent App. Pub. Nos. 2017/0065000 to Sears et al.; 2015/0157052 to Ademe et al.; U.S. Pat. No. 10,314,330 to Conner et al.; U.S. Pat. No. 9,345,268 to Stone et al.; U.S. Pat. No. 9,149,072 to Conner et al.; U.S. Pat. Nos. 5,105,831 and 5,042,509, both to Banerjee et al., each of which is incorporated herein by reference. Components of such systems have the form of articles that are sufficiently compact to be considered hand-held devices. That is, use of components of certain example aerosol delivery devices does not result in the production of smoke in the sense that aerosol results principally from by-products of combustion or pyrolysis of tobacco, but rather, use of those systems results in the production of vapors resulting from volatilization or vaporization of certain components incorporated therein.

Accordingly, in some embodiments, aerosol generating components of the present disclosure may generally include an ignitable heat source configured to heat a substrate material as disclosed herein to aerosolize an aerosol forming material associated with the substrate material, forming an inhalable substance. The substrate material and/or at least a portion of the heat source may be covered in an outer wrap, or wrapping, a casing, a component, a module, a member, or the like. The overall design of the enclosure is variable, and the format or configuration of the enclosure that defines the overall size and shape of the aerosol generating component is also variable. Although other configurations are possible, it may be desirable, in some aspects, that the overall design, size, and/or shape of these embodiments resemble that of a conventional cigarette or cigar.

Substrates in sheet form according to certain embodiments of the disclosure can be used in aerosol generating components of aerosol delivery devices which use electrical energy to heat a substrate material as disclosed herein to aerosolize an aerosol forming material associated with the substrate material, forming an inhalable substance (e.g., electrically heated tobacco products). In some example embodiments, the aerosol delivery devices may be characterized as electronic cigarettes. Accordingly, in some embodiments, aerosol delivery devices of the present disclosure may comprise some combination of a power source (e.g., an electrical power source), at least one control component (e.g., means for actuating, controlling, regulating and ceasing power for heat generation, such as by controlling electrical current flow from the power source to other components of the article, e.g., a microprocessor, individually or as part of a microcontroller), a heat source (e.g., an electrical resistance heating element or other component and/or an inductive coil or other associated components and/or one or more radiant heating elements), and an aerosol generating component that includes a substrate portion as disclosed herein, capable of yielding an aerosol upon application of sufficient heat. Note that it is possible to physically combine one or more of the above-noted components. For instance, in certain embodiments, a conductive heater trace can be printed on the surface of a substrate material as described herein (e.g., a cellulosic film) using a conductive ink such that the heater trace can be powered by the power source and used as the resistance heating element. Example conductive inks include graphene inks and inks containing various metals, such as inks including silver, gold, palladium, platinum, and alloys or other combinations thereof (e.g., silver-palladium or silver-platinum inks), which can be printed on a surface using processes such as gravure printing, flexographic printing, off-set printing, screen printing, ink-jet printing, or other appropriate printing methods.

In various embodiments, a number of these components may be provided within an outer body or shell, which, in some embodiments, may be referred to as a housing. The overall design of the outer body or shell may vary, and the format or configuration of the outer body that may define the overall size and shape of the aerosol delivery device may vary. Although other configurations are possible, in some embodiments an elongated body resembling the shape of a cigarette or cigar may be a formed from a single, unitary housing or the elongated housing can be formed of two or more separable bodies. For example, an aerosol delivery device may comprise an elongated shell or body that may be substantially tubular in shape and, as such, resemble the shape of a conventional cigarette or cigar. In one example, all of the components of the aerosol delivery device are contained within one housing or body. In other embodiments, an aerosol delivery device may comprise two or more housings that are joined and are separable. For example, an aerosol delivery device may possess at one end a control body comprising a housing containing one or more reusable components (e.g., an accumulator such as a rechargeable battery and/or rechargeable supercapacitor, and various electronics for controlling the operation of that article), and at the other end and removably coupleable thereto, an outer body or shell containing a disposable portion (e.g., a disposable flavor-containing aerosol generating component).

Aerosol generating components and aerosol delivery devices comprising the substrate as disclosed herein, and using either heat from combustion or heat from electrical energy to provide an aerosol therefrom, are described further herein below with reference to FIGS. 1-5.

In this regard, FIG. 1 illustrates an aerosol delivery device 100 according to an example embodiment of the present disclosure. The aerosol delivery device 100 may include a control body 102 and an aerosol generating component 104. In some embodiments, the aerosol generating component is configured for use with a conductive and/or inductive heat source to heat a substrate material to form an aerosol. In various embodiments, a conductive heat source may comprise a heating assembly that comprises a resistive heating member. Resistive heating members may be configured to produce heat when an electrical current is directed therethrough.

Electrically conductive materials useful as resistive heating members may be those having low mass, low density, and moderate resistivity and that are thermally stable at the temperatures experienced during use. Useful heating members heat and cool rapidly, and thus provide for the efficient use of energy. Rapid heating of the member may be beneficial to provide almost immediate volatilization of an aerosol forming materials in proximity thereto. Rapid cooling prevents substantial volatilization (and hence waste) of the aerosol forming materials during periods when aerosol formation is not desired. Such heating members may also permit relatively precise control of the temperature range experienced by the aerosol forming materials, especially when time based current control is employed. Useful electrically conductive materials are typically chemically non-reactive with the materials being heated (e.g., aerosol forming materials and other inhalable substance materials) so as not to adversely affect the flavor or content of the aerosol or vapor that is produced. Some example, non-limiting, materials that may be used as the electrically conductive material include carbon, graphite, carbon/graphite composites, metals, ceramics such as metallic and non-metallic carbides, nitrides, oxides, silicides, inter-metallic compounds, cermets, metal alloys, and metal foils. In particular, refractory materials may be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

In various embodiments, a heating member may be provided in a variety of forms, such as in the form of a foil, a foam, a mesh, a hollow ball, a half ball, discs, spirals, fibers, wires, films, yarns, strips, ribbons, or cylinders. Such heating members often comprise a metal material and are configured to produce heat as a result of the electrical resistance associated with passing an electrical current therethrough. Such resistive heating members may be positioned in proximity to, and/or in direct contact with, the substrate portion. For example, in one embodiment, a heating member may comprise a cylinder or other heating device located in the control body 102, wherein the cylinder is constructed of one or more conductive materials, including, but not limited to, copper, aluminum, platinum, gold, silver, iron, steel, brass, bronze, carbon (e.g., graphite), or any combination thereof. In various embodiments, the heating member may also be coated with any of these or other conductive materials. The heating member may be located proximate an engagement end of the control body 102, and may be configured to substantially surround a portion of the heated end 106 of the aerosol generating component 104 that includes the substrate portion 110. In such a manner, the heating member may be located proximate the substrate portion 110 of the aerosol generating component 104 when the aerosol generating component 104 is inserted into the control body 102. In other examples, at least a portion of a heating member may penetrate at least a portion of an aerosol generating component (such as, for example, one or more prongs and/or spikes that penetrate an aerosol generating component), when the aerosol generating component is inserted into the control body. Although in some embodiments the heating member may comprise a cylinder, it should be noted that in other embodiments, the heating member may take a variety of forms and, in some embodiments, may make direct contact with and/or penetrate the substrate portion.

As described above, in addition to being configured for use with a conductive heat source, the presently disclosed aerosol generating component may also be configured for use with an inductive heat source to heat a substrate portion to form an aerosol. In various embodiments, an inductive heat source may comprise a resonant transformer, which may comprise a resonant transmitter and a resonant receiver (e.g., a susceptor). In some embodiments, the resonant transmitter and the resonant receiver may be located in the control body 102. In other embodiments, the resonant receiver, or a portion thereof, may be located in the aerosol generating component 104. For example, in some embodiments, the control body 102 may include a resonant transmitter, which, for example, may comprise a foil material, a coil, a cylinder, or other structure configured to generate an oscillating magnetic field, and a resonant receiver, which may comprise one or more prongs that extend into the substrate portion or are surrounded by the substrate portion. In some embodiments, the aerosol generating component is in intimate contact with the resonant receiver.

In other embodiments, a resonant transmitter may comprise a helical coil configured to circumscribe a cavity into which an aerosol generating component, and in particular, a substrate portion of an aerosol generating component, is received. In some embodiments, the helical coil may be located between an outer wall of the device and the receiving cavity. In one embodiment, the coil winds may have a circular cross section shape; however, in other embodiments, the coil winds may have a variety of other cross section shapes, including, but not limited to, oval shaped, rectangular shaped, L-shaped, T-shaped, triangular shaped, and combinations thereof. In another embodiment, a pin may extend into a portion of the receiving cavity, wherein the pin may comprise the resonant transmitter, such as by including a coil structure around or within the pin. In various embodiments, an aerosol generating component may be received in the receiving cavity wherein one or more components of the aerosol generating component may serve as the resonant receiver. In some embodiments, the aerosol generating component comprises the resonant receiver. Other possible resonant transformer components, including resonant transmitters and resonant receivers, are described in U.S. Pat. App. Pub. No. 2019/0124979 to Sebastian et al., which is incorporated herein by reference in its entirety.

In various embodiments, the aerosol generating component 104 and the control body 102 may be permanently or detachably aligned in a functioning relationship. In this regard, FIG. 1 illustrates the aerosol delivery device 100 in a coupled configuration, whereas FIG. 2 illustrates the aerosol delivery device 100 in a decoupled configuration. Various mechanisms may connect the aerosol generating component 104 to the control body 102 to result in a threaded engagement, a press-fit engagement, an interference fit, a sliding fit, a magnetic engagement, or the like.

In various embodiments, the aerosol delivery device 100 according to an example embodiment of the present disclosure may have a variety of overall shapes, including, but not limited to an overall shape that may be defined as being substantially rod-like or substantially tubular shaped or substantially cylindrically shaped. In the embodiments of FIGS. 1-2, the device 100 has a substantially round cross-section; however, other cross-sectional shapes (e.g., oval, square, triangle, etc.) also are encompassed by the present disclosure. For example, in some embodiments one or both of the control body 102 or the aerosol generating component 104 (and/or any subcomponents) may have a substantially rectangular shape, such as a substantially rectangular cuboid shape (e.g., similar to a USB flash drive). In other embodiments, one or both of the control body 102 or the aerosol generating component 104 (and/or any subcomponents) may have other hand-held shapes. For example, in some embodiments the control body 102 may have a small box shape, various pod mod shapes, or a fob-shape. Thus, such language that is descriptive of the physical shape of the article may also be applied to the individual components thereof, including the control body 102 and the aerosol generating component 104.

Alignment of the components within the aerosol delivery device of the present disclosure may vary across various embodiments. In some embodiments, the substrate portion may be positioned proximate a heat source so as to maximize aerosol delivery to the user. Other configurations, however, are not excluded. Generally, the heat source may be positioned sufficiently near the substrate portion so that heat from the heat source can volatilize the substrate portion (e.g., the aerosol forming material therein) and form an aerosol for delivery to the user. When the heat source heats the substrate portion, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof, wherein such terms are also interchangeably used herein except where otherwise specified.

As noted above, the aerosol delivery device 100 of various embodiments may incorporate a battery and/or other electrical power source to provide current flow sufficient to provide various functionalities to the aerosol delivery device, such as powering of the heat source, powering of control systems, powering of indicators, and the like. As will be discussed in more detail below, the power source may take on various embodiments. The power source may be able to deliver sufficient power to rapidly activate the heat source to provide for aerosol formation and power the aerosol delivery device through use for a desired duration of time. In some embodiments, the power source is sized to fit conveniently within the aerosol delivery device so that the aerosol delivery device can be easily handled. Examples of useful power sources include lithium-ion batteries that are typically rechargeable (e.g., a rechargeable lithium-manganese dioxide battery). In particular, lithium polymer batteries can be used as such batteries can provide increased safety. Other types of batteries—e.g., N50-AAA CADNICA nickel-cadmium cells—may also be used. Additionally, an example power source is of a sufficiently light weight to not detract from a desirable smoking experience. Some examples of possible power sources are described in U.S. Pat. No. 9,484,155 to Peckerar et al., and U.S. Pat. App. Pub. No. 2017/0112191 to Sur et al., the disclosures of which are incorporated herein by reference in their respective entireties.

In specific embodiments, one or both of the control body 102 and the aerosol generating component 104 may be referred to as being disposable or as being reusable. For example, the control body 102 may have a replaceable battery or a rechargeable battery, solid-state battery, thin-film solid-state battery, rechargeable supercapacitor or the like, and thus may be combined with any type of recharging technology, including connection to a wall charger, connection to a car charger (i.e., cigarette lighter receptacle), and connection to a computer, such as through a universal serial bus (USB) cable or connector (e.g., USB 2.0, 3.0, 3.1, USB Type-C), connection to a photovoltaic cell (sometimes referred to as a solar cell) or solar panel of solar cells, a wireless charger, such as a charger that uses inductive wireless charging (including for example, wireless charging according to the Qi wireless charging standard from the Wireless Power Consortium (WPC)), or a wireless radio frequency (RF) based charger. An example of an inductive wireless charging system is described in U.S. Pat. App. Pub. No. 2017/0112196 to Sur et al., which is incorporated herein by reference in its entirety. Further, in some embodiments, the aerosol generating component 104 may comprise a single-use device. A single use component for use with a control body is disclosed in U.S. Pat. No. 8,910,639 to Chang et al., which is incorporated herein by reference in its entirety.

In further embodiments, the power source may also comprise a capacitor. Capacitors are capable of discharging more quickly than batteries and can be charged between puffs, allowing the battery to discharge into the capacitor at a lower rate than if it were used to power the heat source directly. For example, a supercapacitor—e.g., an electric double-layer capacitor (EDLC)—may be used separate from or in combination with a battery. When used alone, the supercapacitor may be recharged before each use of the article. Thus, the device may also include a charger component that can be attached to the smoking article between uses to replenish the supercapacitor.

Further components may be utilized in the aerosol delivery device of the present disclosure. For example, the aerosol delivery device may include a flow sensor that is sensitive either to pressure changes or air flow changes as the consumer draws on the article (e.g., a puff-actuated switch). Other possible current actuation/deactuation mechanisms may include a temperature actuated on/off switch or a lip pressure actuated switch. An example mechanism that can provide such puff-actuation capability includes a Model 163PC01D36 silicon sensor, manufactured by the MicroSwitch division of Honeywell, Inc., Freeport, Ill. Representative flow sensors, current regulating components, and other current controlling components including various microcontrollers, sensors, and switches for aerosol delivery devices are described in U.S. Pat. No. 4,735,217 to Gerth et al., U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., U.S. Pat. No. 7,040,314 to Nguyen et al., and U.S. Pat. No. 8,205,622 to Pan, all of which are incorporated herein by reference in their entireties. Reference is also made to the control schemes described in U.S. Pat. No. 9,423,152 to Ampolini et al., which is incorporated herein by reference in its entirety.

In another example, an aerosol delivery device may comprise a first conductive surface configured to contact a first body part of a user holding the device, and a second conductive surface, conductively isolated from the first conductive surface, configured to contact a second body part of the user. As such, when the aerosol delivery device detects a change in conductivity between the first conductive surface and the second conductive surface, a vaporizer is activated to vaporize a substance so that the vapors may be inhaled by the user holding unit. The first body part and the second body part may be a lip or parts of a hand(s). The two conductive surfaces may also be used to charge a battery contained in the personal vaporizer unit. The two conductive surfaces may also form, or be part of, a connector that may be used to output data stored in a memory. Reference is made to U.S. Pat. No. 9,861,773 to Terry et al., which is incorporated herein by reference in its entirety.

In addition, U.S. Pat. No. 5,154,192 to Sprinkel et al. discloses indicators for smoking articles; U.S. Pat. No. 5,261,424 to Sprinkel, Jr. discloses piezoelectric sensors that can be associated with the mouth-end of a device to detect user lip activity associated with taking a draw and then trigger heating of a heating device; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; U.S. Pat. No. 8,689,804 to Fernando et al. discloses identification systems for smoking devices; and PCT Pat. App. Pub. No. WO 2010/003480 by Flick discloses a fluid flow sensing system indicative of a puff in an aerosol generating system; all of the foregoing disclosures being incorporated herein by reference in their entireties.

Further examples of components related to electronic aerosol delivery articles and disclosing materials or components that may be used in the present device include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944 and 8,375,957 to Hon; U.S. Pat. No. 8,794,231 to Thorens et al.; U.S. Pat. No. 8,851,083 to Oglesby et al.; U.S. Pat. Nos. 8,915,254 and 8,925,555 to Monsees et al.; U.S. Pat. No. 9,220,302 to DePiano et al.; U.S. Pat. App. Pub. Nos. 2006/0196518 and 2009/0188490 to Hon; U.S.

Pat. App. Pub. No. 2010/0024834 to Oglesby et al.; U.S. Pat. App. Pub. No. 2010/0307518 to Wang; PCT Pat. App. Pub. No. WO 2010/091593 to Hon; and PCT Pat. App. Pub. No. WO 2013/089551 to Foo, each of which is incorporated herein by reference in its entirety. Further, U.S. Pat. App. Pub. No. 2017/0099877 to Worm et al. discloses capsules that may be included in aerosol delivery devices and fob-shape configurations for aerosol delivery devices, and is incorporated herein by reference in its entirety. A variety of the materials disclosed by the foregoing documents may be incorporated into the present devices in various embodiments, and all of the foregoing disclosures are incorporated herein by reference in their entireties.

Referring to FIG. 2, in the depicted embodiment, the aerosol generating component 104 comprises a heated end 106, which is configured to be inserted into the control body 102, and a mouth end 108, upon which a user draws to create the aerosol. At least a portion of the heated end 106 includes a substrate portion 110. In some embodiments, the substrate portion 110 comprises a substrate comprising the aerosol forming material, each as disclosed herein. In various embodiments, the aerosol generating component 104, or a portion thereof, may be wrapped in an exterior overwrap material 112. In various embodiments, the mouth end 108 of the aerosol generating component 104 may include a filter 114, which may, for example, be made of a cellulose acetate or polypropylene material. The filter 114 may additionally or alternatively contain strands of tobacco containing material, such as described in U.S. Pat. No. 5,025,814 to Raker et al., which is incorporated herein by reference in its entirety. In various embodiments, the filter 114 may increase the structural integrity of the mouth end of the aerosol generating component 104, and/or provide filtering capacity, if desired, and/or provide resistance to draw. In some embodiments, the filter may comprise discrete segments. For example, some embodiments may include a segment providing filtering, a segment providing draw resistance, a hollow segment providing a space for the aerosol to cool, a segment providing increased structural integrity, other filter segments, and any one or any combination of the above.

In some embodiments, the material of the exterior overwrap 112 may comprise a material that resists transfer of heat, which may include a paper or other fibrous material, such as a cellulose material. The exterior overwrap material may also include at least one filler material imbedded or dispersed within the fibrous material. In various embodiments, the filler material may have the form of water insoluble particles. Additionally, the filler material may incorporate inorganic components. In various embodiments, the exterior overwrap may be formed of multiple layers, such as an underlying, bulk layer and an overlying layer, such as a typical wrapping paper in a cigarette. Such materials may include, for example, lightweight "rag fibers" such as flax, hemp, sisal, rice straw, and/or esparto. The exterior overwrap may also include a material typically used in a filter element of a conventional cigarette, such as cellulose acetate. Further, an excess length of the exterior overwrap at the mouth end 108 of the aerosol generating component may function to simply separate the substrate portion 110 from the mouth of a consumer or to provide space for positioning of a filter material, as described below, or to affect draw on the article or to affect flow characteristics of the vapor or aerosol leaving the device during draw. Further discussions relating to the configurations for exterior overwrap materials that may be used with the present disclosure may be found in U.S. Pat. No. 9,078,473 to Worm et al., which is incorporated herein by reference in its entirety.

Although in some embodiments an aerosol generating component and a control body may be provided together as a complete aerosol delivery article generally, the components may be provided separately. For example, the present disclosure also encompasses a disposable unit for use with a reusable smoking article or a reusable pharmaceutical delivery article. In specific embodiments, such a disposable unit (which may be an aerosol generating component as illustrated in the appended figures) can comprise a substantially tubular shaped body having a heated end configured to engage the reusable aerosol delivery article, an opposing mouth end configured to allow passage of an inhalable substance to a consumer, and a wall with an outer surface and an inner surface that defines an interior space. Various embodiments of an aerosol generating component (or cartridge) are described in U.S. Pat. No. 9,078,473 to Worm et al., which is incorporated herein by reference in its entirety.

Although some figures described herein illustrate the control body and aerosol generating component in a working relationship, it is understood that the control body and the aerosol generating component may exist as individual devices. Accordingly, any discussion otherwise provided herein in relation to the components in combination also should be understood as applying to the control body and the aerosol generating component as individual and separate components.

In another aspect, the present disclosure may be directed to kits that provide a variety of components as described herein. For example, a kit may comprise a control body with one or more aerosol generating components. A kit may further comprise a control body with one or more charging components. A kit may further comprise a control body with one or more batteries. A kit may further comprise a control body with one or more aerosol generating components and one or more charging components and/or one or more batteries. In further embodiments, a kit may comprise a plurality of aerosol generating components. A kit may further comprise a plurality of aerosol generating components and one or more batteries and/or one or more charging components. In the above embodiments, the aerosol generating components or the control bodies may be provided with a heating member inclusive thereto. The inventive kits may further include a case (or other packaging, transporting, or storage component) that accommodates one or more of the further kit components. The case could be a reusable hard or soft container. Further, the case could be simply a box or other packaging structure.

FIG. 3 illustrates a perspective schematic cross-section drawing of the aerosol generating component shown in FIG. 2. In particular, FIG. 3 illustrates the aerosol generating component 104 having a substrate portion 110 that comprises a plurality of beads as disclosed herein and a filter 114. In various embodiments, other components may exist between the substrate portion 110 and the mouth end 108 of the aerosol generating component 104. For example, in some embodiments one or any combination of the following may be positioned between the substrate portion 110 and the mouth end 108 of the aerosol generating component 104: an air gap; a hollow tube structure; phase change materials for cooling air; flavor releasing media; ion exchange fibers capable of selective chemical adsorption; aerogel particles as filter medium; and other suitable materials. Some examples of possible phase change materials include, but are not limited to, salts, such as $AgNO_3$, $AlCl_3$, $TaCl_3$, $InCl_3$, $SnCl_2$, $AlI_3$, and $TiI_4$; metals and metal alloys such as selenium, tin, indium, tin-zinc, indium-zinc, or indium-bismuth; and organic compounds such as D-mannitol, succinic acid, p-nitrobenzoic acid, hydroquinone and adipic acid. Other examples are described in U.S. Pat. No. 8,430,106 to Potter et al., which is incorporated herein by reference in its entirety.

FIG. 4 illustrates a perspective view of an aerosol generating component, according to another example embodiment of the present disclosure, and FIG. 5 illustrates a perspective view of the aerosol generating component of FIG. 4 with an outer wrap removed. In particular, FIG. 4 illustrates an aerosol generating component 200 that includes an outer wrap 202, and FIG. 5 illustrates the aerosol generating component 200 wherein the outer wrap 202 is removed to reveal the other components of the aerosol generating component 200. In the depicted embodiment, the aerosol generating component 200 of the depicted embodiment includes a heat source 204, a substrate portion 210, an intermediate component 208, and a filter 212. In the depicted embodiment, the intermediate component 208 and the filter 212 together comprise a mouthpiece 214.

In various embodiments, the heat source 204 may be configured to generate heat upon ignition thereof. In the depicted embodiment, the heat source 204 comprises a combustible fuel element that has a generally cylindrical shape and that incorporates a combustible carbonaceous material. In other embodiments, the heat source 204 may have a different shape, for example, a prism shape having a triangular, cubic or hexagonal cross-section. Carbonaceous materials generally have a high carbon content. Certain example carbonaceous materials may be composed predominately of carbon, and/or typically may have carbon contents of greater than about 60 percent, generally greater than about 70 percent, often greater than about 80 percent, and frequently greater than about 90 percent, on a dry weight basis.

In some instances, the heat source 204 may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; binding agents, such as guar gum, ammonium alginate and sodium alginate; and/or phase change materials for lowering the temperature of the heat source, described herein above). Although specific dimensions of an applicable heat source may vary, in some embodiments, the heat source 204 may have a length in an inclusive range of approximately 7 mm to approximately 20 mm, and in some embodiments may be approximately 17 mm, and an overall diameter in an inclusive range of approximately 3 mm to approximately 8 mm, and in some embodiments may be approximately 4.8 mm (and in some embodiments, approximately 7 mm). Although in other embodiments, the heat source may be constructed in a variety of ways, in the depicted embodiment, the heat source 204 is extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entireties. Although in various embodiments, the heat source may have a variety of forms, including, for example, a substantially solid cylindrical shape or a hollow cylindrical (e.g., tube) shape, the heat source 204 of the depicted embodiment comprises an extruded monolithic carbonaceous material that has a generally cylindrical shape but with a plurality of grooves 216 extending longitudinally from a first end of the extruded monolithic carbonaceous material to an opposing second end of the extruded monolithic carbonaceous material. In some embodiments, the aerosol delivery device, and in particular, the heat source, may include a heat transfer component. In various embodiments, a heat transfer component may be proximate the heat source, and, in some embodiments, a heat transfer component may be located in or within the heat source. Some examples of heat transfer components are described in in U.S. Pat. App. Pub. No. 2019/0281891 to Hejazi et al., which is incorporated herein by reference in its entirety.

Although in the depicted embodiment, the grooves 216 of the heat source 204 are substantially equal in width and depth and are substantially equally distributed about a circumference of the heat source 204, other embodiments may include as few as two grooves, and still other embodiments may include as few as a single groove. Still other embodiments may include no grooves at all. Additional embodiments may include multiple grooves that may be of unequal width and/or depth, and which may be unequally spaced around a circumference of the heat source. In still other embodiments, the heat source may include flutes and/or slits extending longitudinally from a first end of the extruded monolithic carbonaceous material to an opposing second end thereof. In some embodiments, the heat source may comprise a foamed carbon monolith formed in a foam process of the type disclosed in U.S. Pat. No. 7,615,184 to Lobovsky, which is incorporated herein by reference in its entirety. As such, some embodiments may provide advantages with regard to reduced time taken to ignite the heat source. In some other embodiments, the heat source may be co-extruded with a layer of insulation (not shown), thereby reducing manufacturing time and expense. Other embodiments of fuel elements include carbon fibers of the type described in U.S. Pat. No. 4,922,901 to Brooks et al. or other heat source embodiments such as is disclosed in U.S. Pat. App. Pub. No. 2009/0044818 to Takeuchi et al., each of which is incorporated herein by reference in its entirety.

Generally, the heat source is positioned sufficiently near a substrate portion carrying one or more aerosol forming materials so that the aerosol formed/volatilized by the application of heat from the heat source to the aerosol forming materials (as well as any flavorants, medicaments, and/or the like that are likewise provided for delivery to a user) is deliverable to the user by way of the mouthpiece. That is, when the heat source heats the substrate portion, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof.

Referring back to FIGS. 4 and 5, the outer wrap 202 may be provided to engage or otherwise join together at least a portion of the heat source 204 with the substrate portion 210 and at least a portion of the mouthpiece 214. In various embodiments, the outer wrap 202 is configured to be retained in a wrapped position in any manner of ways including via an adhesive, or a fastener, and the like, to allow the outer wrap 202 to remain in the wrapped position. Otherwise, in some other aspects, the outer wrap 202 may be configured to be removable as desired. For example, upon retaining the outer wrap 202 in a wrapped position, the outer wrap 202 may be able to be removed from the heat source 204, the substrate portion 210, and/or the mouthpiece 214.

In some embodiments, in addition to the outer wrap 202, the aerosol delivery device may also include a liner that is configured to circumscribe the substrate portion 210 and at least a portion of the heat source 204. Although in other embodiments the liner may circumscribe only a portion of the length of the substrate portion 210, in some embodiments, the liner may circumscribe substantially the full length of the substrate portion 210. In some embodiments, the outer wrap material 202 may include the liner. As such, in some embodiments the outer wrap material 202 and the liner may be separate materials that are provided together (e.g., bonded, fused, or otherwise joined together as a laminate). In other embodiments, the outer wrap 202 and the liner may be the same material. In any event, the liner may be configured to thermally regulate conduction of the heat generated by the ignited heat source 204, radially outward of the liner. As such, in some embodiments, the liner may be constructed of a metal foil material, an alloy material, a ceramic material, or other thermally conductive amorphous carbon-based material, and/or an aluminum material, and in some embodiments may comprise a laminate. In some embodiments, depending on the material of the outer wrap 202 and/or the liner, a thin layer of insulation may be provided radially outward of the liner. Thus, the liner may advantageously provide, in some aspects, a manner of engaging two or more separate components of the aerosol generating component 200 (such as, for example, the heat source 204, the substrate portion 210, and/or a portion of the mouthpiece 214), while also providing a manner of facilitating heat transfer axially therealong, but restricting radially outward heat conduction.

As shown in FIG. 4, the outer wrap 202 (and, as necessary, the liner, and the substrate portion 210) may also include one or more openings formed therethrough that allow the entry of air upon a draw on the mouthpiece 214. In various embodiments, the size and number of these openings may vary based on particular design requirements. In the depicted embodiment, a plurality of openings 220 are located proximate an end of the substrate portion 210 closest to the heat source 204, and a plurality of separate cooling openings 221 are formed in the outer wrap 202 (and, in some embodiments, the liner) in an area proximate the filter 212 of the mouthpiece 214. Although other embodiments may differ, in the depicted embodiment, the openings 220 comprise a plurality of openings substantially evenly spaced about the outer surface of the aerosol generating component 200, and the openings 221 also comprise a plurality of openings substantially evenly spaced around the outer surface of the aerosol generating component 200. Although in various embodiments the plurality of openings may be formed through the outer wrap 202 (and, in some embodiments, the liner) in a variety of ways, in the depicted embodiment, the plurality of openings 220 and the plurality of separate cooling openings 221 are formed via laser perforation.

The aerosol generating component 200 of the depicted implementation also includes an intermediate component 208 and at least one filter 212. It should be noted that in various implementations, the intermediate component 208 or the filter 212, individually or together, may be considered a mouthpiece 214 of the aerosol generating component 200. Although in various implementations, neither the intermediate component nor the filter need be included, in the depicted implementation the intermediate component 208 comprises a substantially rigid member that is substantially inflexible along its longitudinal axis. In the depicted implementation, the intermediate component 208 comprises a hollow tube structure, and is included to add structural integrity to the aerosol generating component 200 and provide for cooling the produced aerosol. In some implementations, the intermediate component 208 may be used as a container for collecting the aerosol. In various implementations, such a component may be constructed from any of a variety of materials and may include one or more adhesives. Example materials include, but are not limited to, paper, paper layers, paperboard, plastic, cardboard, and/or composite materials. In the depicted implementation, the intermediate component 208 comprises a hollow cylindrical element constructed of a paper or plastic material (such as, for example, ethyl vinyl acetate (EVA), or other polymeric materials such as poly ethylene, polyester, silicone, etc. or ceramics (e.g., silicon carbide, alumina, etc.), or other acetate fibers), and the filter comprises a packed rod or cylindrical disc constructed of a gas permeable material (such as, for example, cellulose acetate or fibers such as paper or rayon, or polyester fibers).

As noted, in some implementations the mouthpiece 214 may comprise a filter 212 configured to receive the aerosol therethrough in response to the draw applied to the mouthpiece 214. In various implementations, the filter 212 is provided, in some aspects, as a circular disc radially and/or longitudinally disposed proximate the second end of the intermediate component 208. In this manner, upon draw on the mouthpiece 214, the filter 212 receives the aerosol flowing through the intermediate component 208 of the aerosol generating component 200. In some implementations, the filter 212 may comprise discrete segments. For example, some implementations may include a segment providing filtering, a segment providing draw resistance, a hollow segment providing a space for the aerosol to cool, a segment providing increased structural integrity, other filter segments, and any one or any combination of the above. In some implementations, the filter 212 may additionally or alternatively contain strands of tobacco containing material, such as described in U.S. Pat. No. 5,025,814 to Raker et al., which is incorporated herein by reference in its entirety.

In various implementations the size and shape of the intermediate component 208 and/or the filter 212 may vary, for example the length of the intermediate component 208 may be in an inclusive range of approximately 10 mm to approximately 30 mm, the diameter of the intermediate component 208 may be in an inclusive range of approximately 3 mm to approximately 8 mm, the length of the filter 212 may be in an inclusive range of approximately 10 mm to approximately 20 mm, and the diameter of the filter 212 may be in an inclusive range of approximately 3 mm to approximately 8 mm. In the depicted implementation, the intermediate component 208 has a length of approximately 20 mm and a diameter of approximately 4.8 mm (and in some implementations, approximately 7 mm), and the filter 212 has a length of approximately 15 mm and a diameter of approximately 4.8 mm (or in some implementations, approximately 7 mm).

In various implementations, ignition of the heat source 204 results in aerosolization of the aerosol forming materials associated with the substrate portion 210. In certain embodiments, the elements of the substrate portion 210 do not experience thermal decomposition (e.g., charring, scorching, or burning) to any significant degree, and the aerosolized components are entrained in the air that is drawn through the aerosol generating component 200, including the filter 212, and into the mouth of the user. In various implementations, the mouthpiece 214 (e.g., the intermediate component 208 and/or the filter 212) is configured to receive the generated aerosol therethrough in response to a draw applied to the mouthpiece 214 by a user. In some implementations, the mouthpiece 214 may be fixedly engaged to the substrate portion 210. For example, an adhesive, a bond, a weld, and the like may be suitable for fixedly engaging the mouthpiece 214 to the substrate portion 210. In one example, the mouthpiece 214 is ultrasonically welded and sealed to an end of the substrate portion 210.

Although an aerosol deliver device and/or an aerosol generating component according to the present disclosure may take on a variety of embodiments, as discussed in detail above, the use of the aerosol delivery device and/or aerosol generating component by a consumer will be similar in scope. The foregoing description of use of the aerosol delivery device and/or aerosol generating component is applicable to the various embodiments described through minor modifications, which are apparent to the person of skill in the art in light of the further disclosure provided herein. The description of use, however, is not intended to limit the use of the articles of the present disclosure but is provided to comply with all necessary requirements of disclosure herein.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

EXAMPLES

Aspects of the present invention are more fully illustrated by the following examples, which are set forth to illustrate certain aspects of the present invention and are not to be construed as limiting thereof.

Example 1. Beaded Substrate Embodiment with Milled Botanical

In one embodiment, a beaded substrate comprising the ingredients set forth in Table 1 below is prepared. The actual ingredients and percentages can be varied depending on the desired properties of the final product. Milled tobacco, milled botanical, and carboxymethylcellulose are weighed into a mixer (model FM 130 D Littleford precision plough mixer) and mixed on medium speed for 5 minutes. Water (amount dependent on the binder used) is added, followed by glycerol and the combination mixed on medium speed for approximately one minute, or until pea-like clumps are observed. The chopper motor is run for approximately 5 seconds, then the mixture is mixed at low speed and discharged into a receiver. The mixture is extruded using a 1.5 mm doomed screen die on an Osaka Multi-Gran MG-55 extruder (Fuji Paudal Co., Ltd.), resulting in multi-grain (hair-like) shaped rods. The extrudate rods are subsequently transferred into a model QJ-230T-2 Fuji Paudal Co. Ltd. laboratory marumerizer. The marumerizer rotating bowl is used to reshape the rods into rounded beads. The rods are spheronized (time may vary from about 19 seconds to about 2 minutes. 19 seconds to give beads, which are dried for 30-45 minutes at 65° C., providing a target moisture content of about 6%+/−3%. The resulting beads are screened to between 8 and 16 mesh (average particle size distribution is 0.149 mm, and bead weight is 25 to 26 milligrams). On a dry weight basis, the beads contain approximately 25% milled botanical, 48% milled tobacco, 20% glycerol and 1% binder.

TABLE 1

Formulation of milled botanical beaded substrate embodiment

| Component | Percent by wt |
|---|---|
| Milled tobacco | 10-45 |
| Milled botanical | 15-60 |
| Glycerol | 10-20 |
| Water | 20-30 |
| Carboxymethylcellulose | 0.5-1.5 |
| Total | 100 |

Example 2. Beaded Substrate Embodiment with Milled Botanical, Non-Nicotine

In another embodiment, a beaded substrate comprising the ingredients set forth in Table 1 is prepared. Example 2 is produced in a similar manner as to that outlined for Example 1, except that the milled tobacco has been processed to extract substantially all of the nicotine. The beads are dried to 6+/−3% moisture content. On a dry weight basis, the beads contain approximately 25% milled botanical, 48% milled tobacco, 20% glycerol and 1% binder.

Example 3. Beaded Substrate Embodiment with Milled Botanical, Tobacco-Free

In one embodiment, beaded substrates comprising the ingredients set forth in Table 2 below are prepared. The actual ingredients and percentages can be varied depending on the desired properties of the final product. Milled botanical, optional filler (e.g., wood pulp), and binder (e.g., carboxymethylcellulose) are weighed into a mixer (model FM 130 D Littleford precision plough mixer) and mixed on medium speed for 5 minutes. Water (amount dependent on the binder used) is added, followed by glycerol, and the combination mixed on medium speed for approximately one minute, or until pea-like clumps are observed. The chopper motor is run for approximately 5 seconds, then the mixture is mixed at low speed and discharged into a receiver. The mixture is extruded using a 1.5 mm doomed screen die on an Osaka Multi-Gran MG-55 extruder (Fuji Paudal Co., Ltd.), resulting in multi-grain (hair-like) shaped rods. The extrudate rods are subsequently transferred into a model QJ-230T-2 Fuji Paudal Co. Ltd. laboratory marumerizer. The marumerizer rotating bowl is used to reshape the rods into rounded beads. The rods are spheronized (time may vary from about 19 seconds to about 2 minutes. 19 seconds to give beads, which are dried for 30-45 minutes at 65° C., providing a target moisture content of about 6%+/−3%. The resulting beads are screened to between 8 and 16 mesh (average particle size distribution is 0.149 mm, and bead weight is 25 to 26 milligrams).

TABLE 2

| Formulation of milled botanical beaded substrate embodiment | |
|---|---|
| Component | Percent by wt |
| Milled botanical | 15-75 |
| Filler | 0-45 |
| Glycerol | 8-12 |
| Water | 11-17 |
| Binder | 0.5-1.5 |
| Total | 100 |

Example 4. Beaded Substrate Embodiment with Botanical Extract

In another embodiment, a beaded substrate comprising the ingredients set forth in Table 3 below is prepared. The actual ingredients and percentages can be varied depending on the desired properties of the final product. Milled tobacco, carboxymethylcellulose, and botanical extract are weighed into a mixer (model FM 130 D Littleford precision plough mixer) and mixed on medium speed for 5 minutes. Water (amount dependent on the binder used) is added, followed by glycerol and the combination mixed on medium speed for approximately one minute, or until pea-like clumps are observed The chopper motor is run for approximately 5 seconds, then the mixture is mixed at low speed and discharged into a receiver. The composition is extruded using a 1.5 mm die on an Osaka Multi-Gran MG-55 extruder (Fuji Paudal Co., Ltd.). The extrudate is spheronized (time may vary from about 19 seconds to about 2 minutes. 19 seconds). The beads are then dried for 30-45 minutes at 65° C., providing beads with a target moisture content of about 6%, +/−3%. The resulting beads are screened to between 8 and 16 mesh (average particle size distribution is 0.149 mm, and bead weight is 25 to 26 milligrams). On a dry weight basis, the beads contained approximately 20% glycerol and 2.5% botanical extract.

TABLE 3

| Formulation of beaded substrate embodiment with botanical extract | |
|---|---|
| Component | Percent by wt |
| Milled tobacco | 55-65 |
| Glycerol | 10-20 |
| Water | 15-25 |
| Carboxymethylcellulose | 0.5-1.5 |
| Botanical extract | 1-5 |
| Total | 100 |

Example 5. Beaded Substrate Embodiment with Botanical Extract, Non-Nicotine

In another embodiment, a beaded substrate comprising the ingredients set forth in Table 4 is prepared. The actual ingredients and percentages can be varied depending on the desired properties of the final product. Milled tobacco (processed to extract substantially all of the nicotine), botanical extract, rice flour, and carboxymethylcellulose are weighed into a mixer (model FM 130 D Littleford precision plough mixer) and mixed on medium speed for 5 minutes. Water (in an amount dependent upon binder used) and then glycerol are added, and the mixture mixed on medium speed for approximately one minute, or until pea-like lumps are observed. The chopper motor is run for approximately 5 seconds, then the mixture is mixed at low speed and discharged into a receiver. The composition is extruded using a 1.5 mm die on an Osaka Multi-Gran MG-55 extruder (Fuji Paudal Co., Ltd.). The extrudate is spheronized (time may vary from about 19 seconds to about 2 minutes). The beads are then dried for 30-45 minutes at 65° C., providing beads with a target moisture content of about 6%, +/−3%.

TABLE 4

| Formulation of botanical extract beaded substrate embodiment | |
|---|---|
| Component | Percent by wt |
| Milled tobacco | 30-45 |
| Glycerol | 10-20 |
| Water | 20-30 |
| Carboxymethylcellulose | 0.5-1.5 |
| Rice flour | 15-25 |
| Botanical extract | 1-5 |
| Total | 100 |

Example 6. Beaded Substrate Embodiment with Flavorant

In another embodiment, a beaded substrate comprising the ingredients set forth in Table 5 is prepared. Example 6 is produced in a similar manner as to that outlined for Example 4, except that the botanical extract is replaced with a flavorant. On a dry weight basis, the beads contain approximately 20% glycerol and 2.5% flavorant.

TABLE 5

| Formulation of flavor beaded substrate embodiment | |
|---|---|
| Component | Percent by wt |
| Milled tobacco | 55-65 |
| Glycerol | 10-20 |
| Water | 15-25 |
| Carboxymethylcellulose | 0.5-1.5 |
| Flavorant | 1-5 |
| Total | 100 |

Example 7. Beaded Substrate Embodiment with Flavorant, Non-Nicotine

In another embodiment, a beaded substrate comprising the ingredients set forth in Table 6 is prepared. Example 7 is produced in a similar manner as to that outlined for Example 5, except that the milled tobacco has been processed to extract substantially all of the nicotine. On a dry weight basis, the beads contain approximately 20% glycerol and 2.5% flavorant.

TABLE 6

| Formulation of botanical extract beaded substrate embodiment | |
|---|---|
| Component | Percent by wt |
| Milled tobacco | 30-45 |
| Glycerol | 10-20 |

TABLE 6-continued

| Formulation of botanical extract beaded substrate embodiment | |
|---|---|
| Component | Percent by wt |
| Water | 20-30 |
| carboxymethylcellulose | 0.5-1.5 |
| Rice flour | 15-25 |
| Flavorant | 1-5 |
| Total | 100 |

What is claimed is:

1. A substrate in beaded form for use in an aerosol delivery device, the substrate comprising:

a tobacco material in particulate form, present in the substrate in an amount from about 10% to about 45% by weight, based on a total wet weight of the substrate, wherein the tobacco material is substantially free of nicotine;

a botanical extract in an amount from about 1 to about 5% by weight, based on the total wet weight of the substrate;

a binder in an amount from about 0.5% to about 1.5% by weight, based on the total wet weight of the substrate, the binder selected from the group consisting of methylcellulose, hydroxypropylcellulose, hydroxypropylmethylcellulose, hydroxyethyl cellulose, carboxymethylcellulose, and combinations thereof;

water in an amount from about 20% to about 30% by weight, based on the total wet weight of the substrate;

an aerosol forming component in an amount from about 10% to about 20% by weight, based on the total wet weight of the substrate; and a filler in an amount from about 15% to about 25% by weight, based on the total wet weight of the substrate the filler selected from the group consisting of corn starch, rice starch or rice flour, modified food starch, and combinations thereof.

2. The substrate of claim 1, wherein the binder is carboxymethylcellulose.

3. The substrate of claim 1, wherein the aerosol forming component is selected from the group consisting of water, a polyhydric alcohol, a polysorbate, a sorbitan ester, a fatty acid, a fatty acid ester, a wax, a cannabinoid, a terpene, a sugar alcohol, or a combination thereof.

4. The substrate of claim 1, wherein the aerosol forming component comprises a polyhydric alcohol, wherein the polyhydric alcohol is selected from the group consisting of glycerol, propylene glycol, 1,3-propanediol, diethylene glycol, triethylene glycol, triacetin, and combinations thereof, wherein the polyhydric alcohol is present in an amount from about 10 to about 20% by weight, based on the total weight of the substrate.

5. The substrate of claim 1, wherein the filler is rice flour.

6. An aerosol delivery device, comprising:

the substrate of claim 1;

a heat source configured to heat the substrate to form an aerosol; and an aerosol pathway extending from the substrate to a mouth-end of the aerosol delivery device.

7. The aerosol delivery device of claim 6, wherein the heat source comprises either an electrically powered heating element or a combustible ignition source.

8. The aerosol delivery device of claim 7, wherein the heat source is a combustible ignition source comprising a carbon-based material.

9. The aerosol delivery device of claim 7, wherein the heat source is an electrically-powered heating element.

10. The aerosol delivery device of claim 9, further comprising a power source electronically connected to the heating element.

11. The aerosol delivery device of claim 10, further comprising a controller configured to control the power transmitted by the power source to the heating element.

* * * * *